US011104137B2

(12) United States Patent
Tanioku et al.

(10) Patent No.: US 11,104,137 B2
(45) Date of Patent: Aug. 31, 2021

(54) LIQUID DISCHARGING APPARATUS

(71) Applicant: RICOH COMPANY, LTD., Tokyo (JP)

(72) Inventors: Yuichi Tanioku, Kanagawa (JP); Hisashi Habashi, Kanagawa (JP); Yuusuke Koizuka, Kanagawa (JP); Koji Katsuragi, Kanagawa (JP); Yuuki Yokohama, Kanagawa (JP); Masaki Kudo, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/820,124

(22) Filed: Mar. 16, 2020

(65) Prior Publication Data

US 2020/0316945 A1 Oct. 8, 2020

(30) Foreign Application Priority Data

Apr. 4, 2019 (JP) ..... JP2019-072140

(51) Int. Cl.
*B41J 2/17* (2006.01)
*B41J 2/165* (2006.01)

(52) U.S. Cl.
CPC ..... *B41J 2/165* (2013.01); *B41J 2/1721* (2013.01)

(58) Field of Classification Search
CPC ..... B41J 2/165; B41J 2/1721
See application file for complete search history.

(56) References Cited

U.S. PATENT DOCUMENTS

| | | | | |
|---|---|---|---|---|
| 7,931,350 | B2 * | 4/2011 | Furukawa | B41J 2/1721 347/36 |
| 2004/0267223 | A1 * | 12/2004 | Etchells | B65D 81/264 604/385.01 |
| 2016/0250857 | A1 * | 9/2016 | Imai | B41J 2/16523 347/31 |
| 2018/0264822 | A1 | 9/2018 | Tanioku et al. | |
| 2019/0255869 | A1 * | 8/2019 | Asakawa | C09D 11/322 |
| 2019/0263127 | A1 | 8/2019 | Tanioku | |

FOREIGN PATENT DOCUMENTS

| | | |
|---|---|---|
| JP | 2000-203059 | 7/2000 |
| JP | 2014-208472 | 11/2014 |
| JP | 6307970 | 3/2018 |

* cited by examiner

*Primary Examiner* — Sharon Polk
(74) *Attorney, Agent, or Firm* — Grüneberg and Myers PLLC

(57) ABSTRACT

Provided is a liquid discharging apparatus including a liquid discharging unit configured to discharge a liquid, and a dummy discharge receptacle including an absorbing member configured to absorb a liquid dummy-discharged by the liquid discharging unit, wherein the liquid discharging unit discharges a liquid having a resin content of 5% by mass or greater, and wherein the absorbing member of the dummy discharge receptacle is formed of melamine foam.

12 Claims, 16 Drawing Sheets

LIQUID DISCHARGING APPARATUS

CROSS-REFERENCE TO RELATED APPLICATIONS

The present application claims priority under 35 U.S.C. § 119 to Japanese Patent Application No. 2019-072140 filed Apr. 4, 2019. The contents of which are incorporated herein by reference in their entirety.

BACKGROUND OF THE INVENTION

Field of the Invention

The present disclosure relates to a liquid discharging apparatus.

Description of the Related Art

For example, printing apparatuses serving as liquid discharging apparatuses are configured to perform dummy discharging (including an operation called flushing or purge) of discharging a liquid that does not contribute to printing, toward a dummy discharge receptacle provided with an absorbing member, for maintenance of the liquid discharging heads.

An existing technique performs flushing toward a waste liquid tank in which two layers of absorbing members formed of, for example, melamine foam are accommodated (see Japanese Unexamined Patent Application Publication No. 2014-208472).

When a liquid having a high resin content is used as the liquid, there is a problem that deposition occurs over the absorbing member in the dummy discharge receptacle, due to drying and solidification of the liquid discharged over the absorbing member.

SUMMARY OF THE INVENTION

According to one aspect of the present disclosure, a liquid discharging apparatus includes a liquid discharging unit configured to discharge a liquid, and a dummy discharge receptacle including an absorbing member configured to absorb a liquid dummy-discharged by the liquid discharging unit. The liquid discharging unit discharges a liquid having a resin content of 5% by mass or greater. The absorbing member of the dummy discharge receptacle is formed of melamine foam.

DESCRIPTION OF THE EMBODIMENTS

The present disclosure has been made in view of the problem described above, and has an object to suppress deposition over an absorbing member.

According to the present disclosure, it is possible to suppress deposition over an absorbing member.

Figure 1:
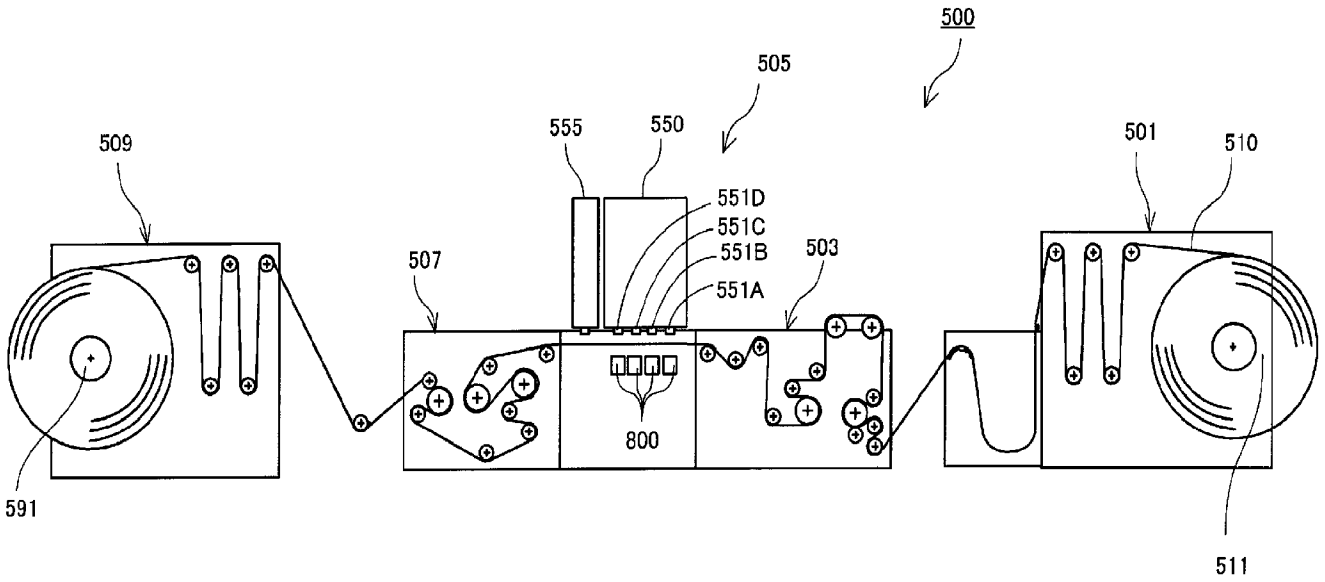
FIG. 1 is a schematic diagram of an example printing apparatus serving as a liquid discharging apparatus of the present disclosure.
Figure 2:
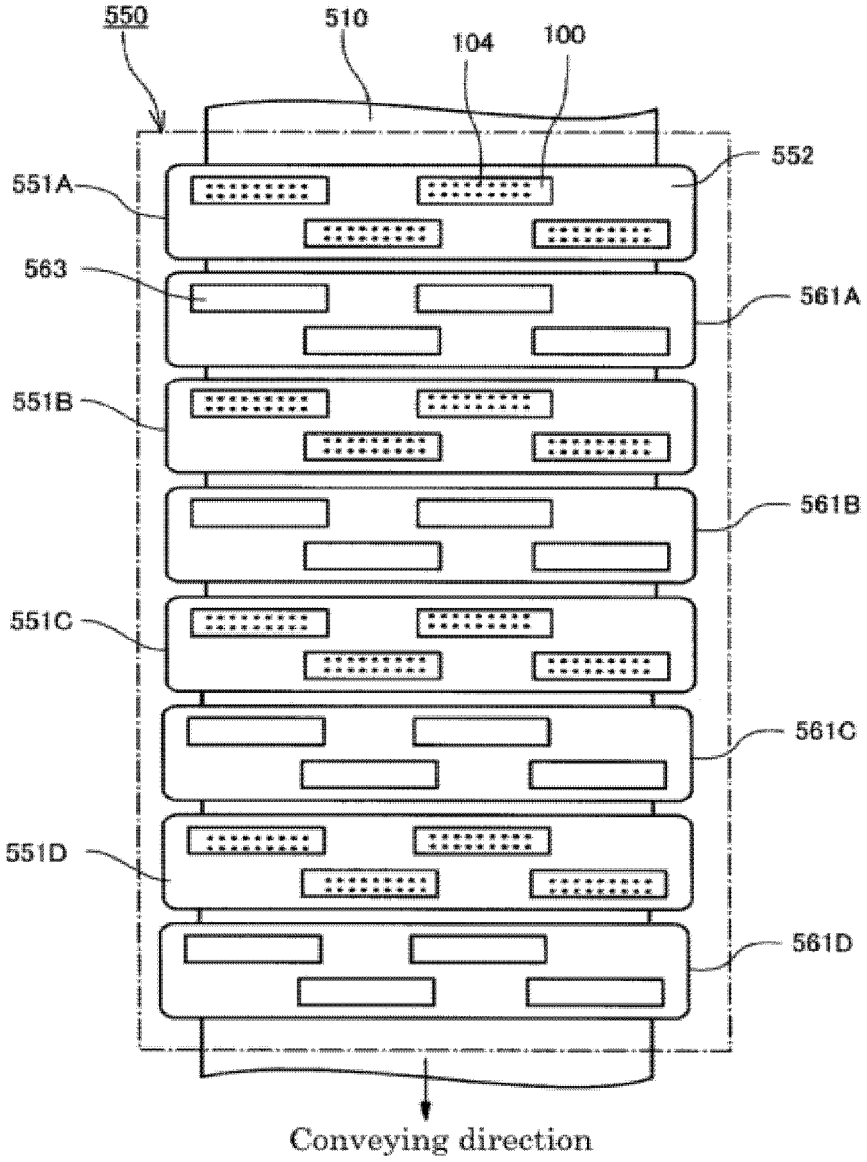
FIG. 2 is a plan view illustrating an example of a portion of a printing unit of a printing apparatus serving as a liquid discharging apparatus of the present disclosure.
Figure 3:
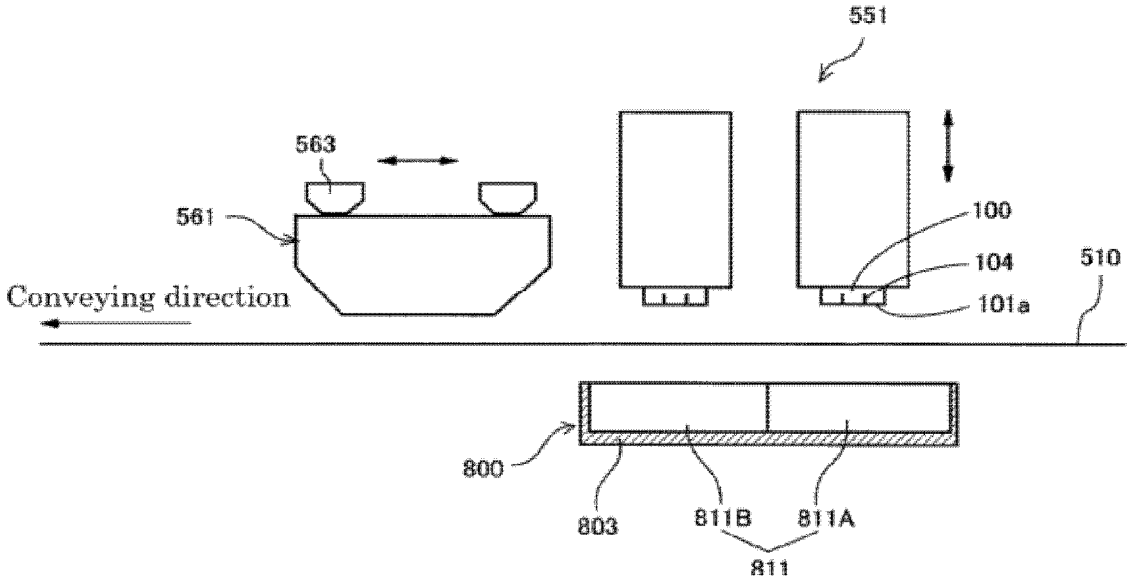
FIG. 3 is a side view illustrating an example of a portion of a printing unit serving as a liquid discharging apparatus of the present disclosure.

Embodiments of the present disclosure will be described below with reference to the attached drawings. An example of a printing apparatus serving as a liquid discharging apparatus of the present disclosure will be described with reference to FIG. 1 to FIG. 3. FIG. 1 is a schematic diagram of the example printing apparatus. FIG. 2 is a plan view illustrating a portion of a printing unit of the printing apparatus. FIG. 3 is a side view illustrating a portion of the printing unit.

A printing apparatus 500 serving as the liquid discharging apparatus includes, for example, a carry-in unit 501 configured to carry in a sheet material 510 such as continuous paper, a guiding conveyor unit 503 configured to guide and convey the sheet material 510 carried in by the carry-in unit 501 to a printing unit 505, the printing unit 505 configured to perform printing of discharging a liquid over the sheet material 510 to form an image, a drying unit 507 configured to dry the sheet material 510, and a carry-out unit 509 configured to carry out the sheet material 510.

The sheet material 510 is sent out from an original winding roller 511 of the carry-in unit 501, guided and conveyed by rollers of the guiding conveyor unit 503, the drying unit 507, and the carry-out unit 509, and wound up by a winding roller 591 of the carry-out unit 509.

The sheet material 510 is conveyed in the printing unit 505, being faced with a head unit 550 and a head unit 555. An image is formed over the sheet material 510 with a liquid discharged from the head unit 550. A post-process is applied to the sheet material 510 with a processing fluid discharged from the head unit 555.

In the head unit 550, full line-type head arrays 551 for four colors (551A, 551B, 551C, and 551D) are arranged from, for example, the upstream side in the conveying direction.

The head arrays 551 are liquid discharging units, and configured to discharge liquids of, for example, black K, cyan C, magenta M, and yellow Y respectively to the sheet material 510 conveyed. The kinds and the number of the colors are not limited to as described above.

Each head array 551 is formed of liquid discharging heads (may also be referred to simply as "heads") 100 staggered over a base member 552, each liquid discharging head 100 including a plurality of nozzles 104, the plurality of nozzles 14 being configured to discharge a liquid and arranged in two lines in a staggered state. However, the head array 551 is not limited to as described above.

Maintenance units 561 (561A to 561D) configured to maintain the heads 100 are disposed between the head arrays 551. The maintenance units 561 include caps 563 configured to cap nozzle surfaces 101*a* of the heads 100.

The maintenance units 561 are disposed reciprocably in the direction of the arrow in FIG. 3. The head arrays 551 are disposed liftably upward and downward. For capping, the head arrays 551 are lifted upward, so that the maintenance units 561 may move to below the heads 100. Then, the head arrays 551 are lifted downward, so that the nozzle surfaces 101*a* of the heads 100 may be capped with the caps 563.

A dummy discharge receptacle 800 of the present disclosure configured to receive dummy-discharged droplets discharged through the nozzles 104 of the heads 100 is disposed below the head arrays 551.

Figure 4:
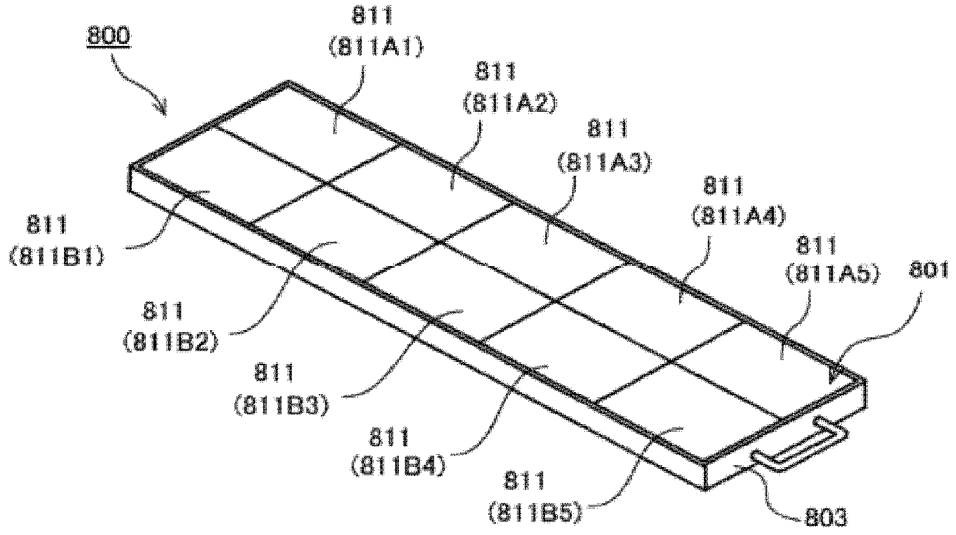
FIG. 4 is a perspective view illustrating an example dummy discharge receptacle of a first embodiment of the present disclosure.
Figure 5:
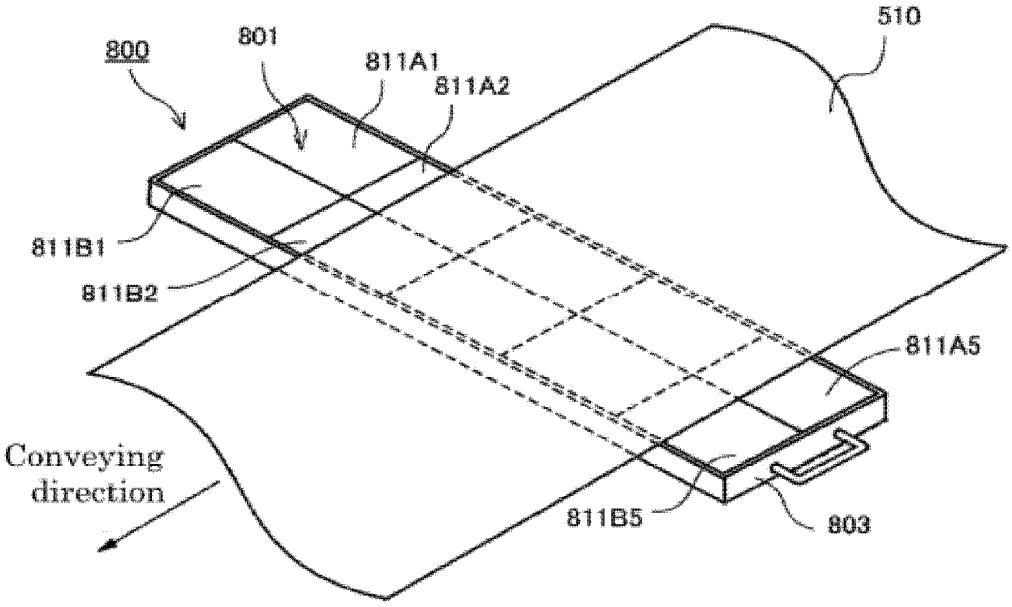
FIG. 5 is a perspective view illustrating a dummy discharge receptacle of a first embodiment together with a sheet material.

Next, the dummy discharge receptacle of the first embodiment of the present disclosure will be described with reference to FIG. 4 to FIG. 7. FIG. 4 is a perspective view illustrating the dummy discharge receptacle. FIG. 5 is a perspective view illustrating the dummy discharge receptacle together with the sheet material.

The dummy discharge receptacle 800 includes an absorbing member (referred to as "first absorbing member" in order to unify the name and reference sign with the embodiments to be described below) 801, and a tray 803, which is a receptacle member configured to accommodate the first absorbing member 801.

The first absorbing member 801 is divided into a plurality of blocks (block bodies, or segments) 811 (811A1 to 811A5, and blocks 811B1 to 811B5) in the in-plane direction of a surface over which dummy-discharged droplets land. The blocks 811 are arranged side by side in the tray 803. The blocks 811 are arranged in contact with each other by side surfaces. Here, the first absorbing member is divided into blocks as independent pieces.

It is preferable that the first absorbing member 801 be divided into at least three blocks 811 including both end blocks and a central block in the longer direction (i.e., a direction orthogonal to the conveying direction of the sheet material). In the present embodiment, the first absorbing member 801 is divided into five blocks 811A1 to 811A5 or 811B1 to 811B5, which are arranged side by side in the direction orthogonal to the conveying direction.

This enables a maintenance operation of, for example, replacing only such blocks 811 that face the heads 100 in a region outside the coverage of the sheet material 510 in the longer direction, and to which the dummy-discharged liquid (dummy-discharged droplets) lands.

It is preferable to divide the first absorbing member 801 in the shorter direction (i.e., a direction along the conveying direction of the sheet material) in a manner to correspond to the number by which the heads 100 are present in the conveying direction. In the printing apparatus 500, the heads 100 are arranged in two lines by the staggered arrangement. Hence, in the present embodiment, the first absorbing member 801 is divided into two lines, namely the upstream blocks 811A (811A1 to 811A5) and the downstream blocks 811B (811B1 to 811B5), which are arranged side by side in the direction along the conveying direction of the sheet material.

Hence, the blocks 811 face any of the upstream heads 100 and the downstream heads 100. This makes the area of one block 811, over which the dummy-discharged liquid (dummy-discharged droplets) lands in the region outside the coverage of the sheet material 510, smaller than when the first absorbing member is divided only in the longer direction, making it possible to further restrict the blocks to become the target of maintenance such as replacement.

As the first absorbing member 801, a porous body that has a high liquid permeation speed and a low capillary force, such as melamine foam, can be used. With a high liquid permeation speed, a liquid that lands on the first absorbing member 801 quickly permeates the inside of the first absorbing member 801, and tends not to stay near the surface of the first absorbing member 801, making it possible to suppress growth of a deposit.

The melamine foam, which is produced by blending and mixing, for example, a foaming agent, a catalyst, and an emulsifier with melamine and formaldehyde, which are the main ingredients, or a precondensate of the main ingredients, subsequently injecting the resultant into a mold, making the foamable materials generate heat by an appropriate measure such as heating, and foaming and hardening the resultant, can be increased in the liquid absorbing ability to a desired level, by further compression for improving the foaming volume.

Figure 6:
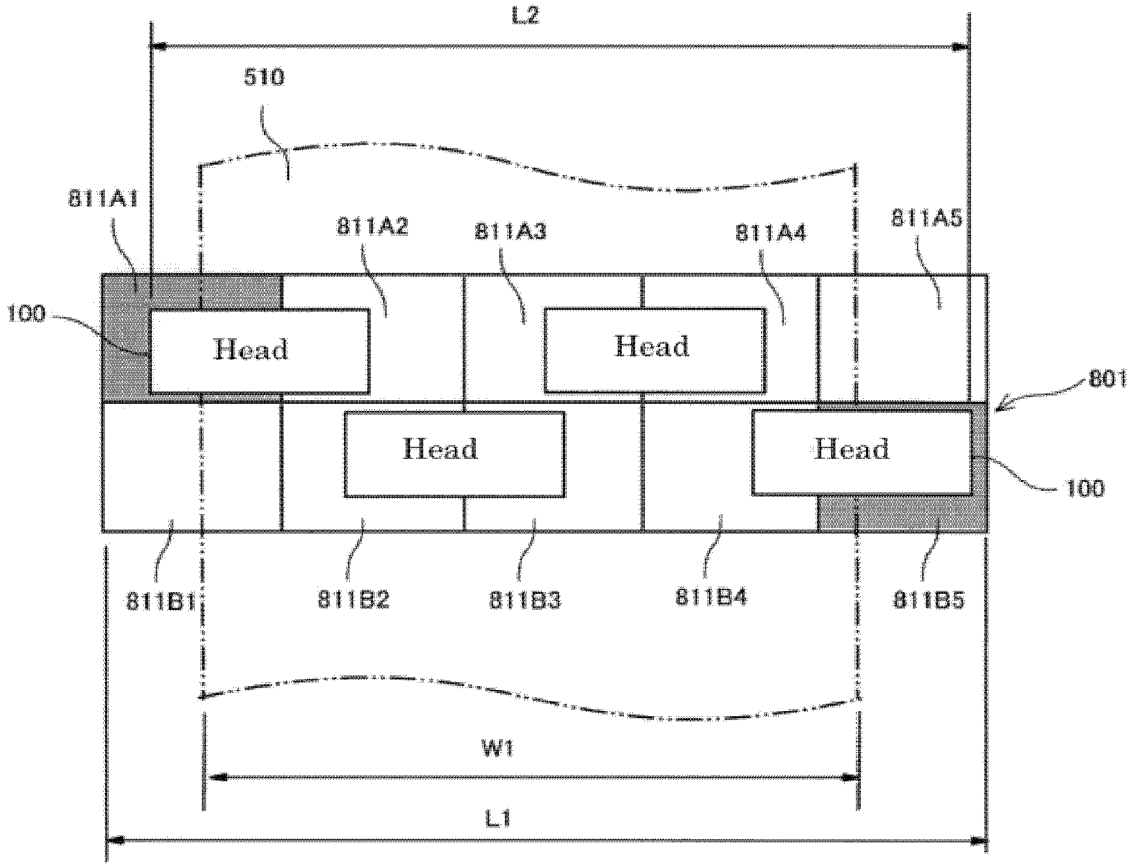
FIG. 6 is a plan view illustrating an example positional relationship among a dummy discharge receptacle of a first embodiment, heads, and a sheet material.
Figure 7:
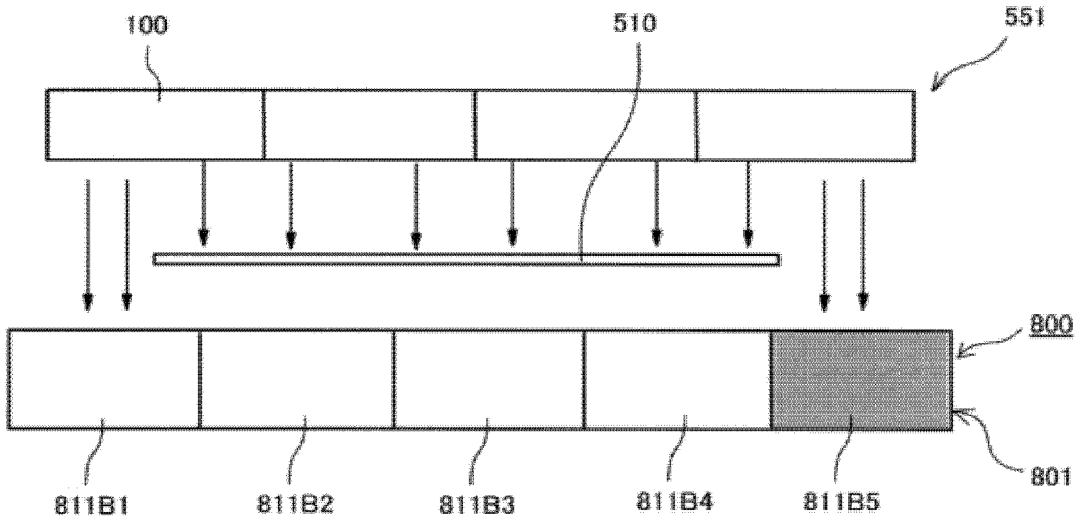
FIG. 7 is a front view illustrating an example positional relationship among a dummy discharge receptacle of a first embodiment, heads, and a sheet material.
Figure 8:
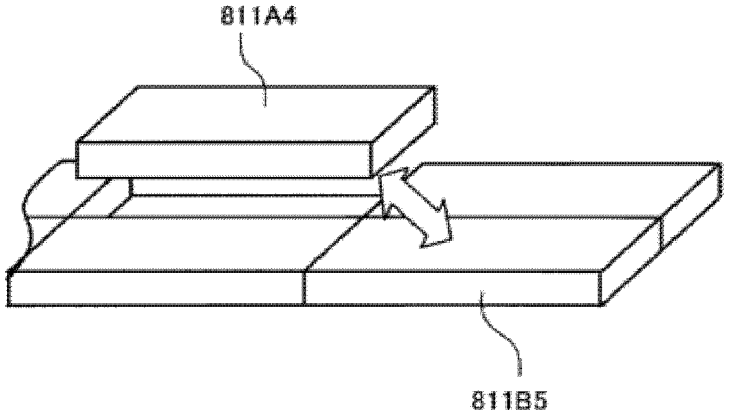
FIG. 8 is a perspective view illustrating an example when mutually exchanging some blocks of a dummy discharge receptacle of a first embodiment.

Next, replacement of the blocks of the dummy discharge receptacle in the present embodiment will be described with reference to FIG. 6 to FIG. 8. FIG. 6 is a plan view illustrating an example positional relationship among the dummy discharge receptacle, the heads, and the sheet material. FIG. 7 is a front view of the same. FIG. 8 is a perspective view illustrating mutual exchange of some blocks of the dummy discharge receptacle.

Like the printing apparatus 500 described above, apparatuses configured to perform printing over the sheet material 510 such as continuous paper are supposed to perform dummy discharging in a state that the sheet material 510 is faced with the heads 100. Therefore, in the direction orthogonal to the conveying direction, the dummy-discharged liquid (dummy-discharged droplets) lands on the sheet material 510 in a region where the sheet material 510 is intermediately present above the dummy discharge receptacle 800, and the dummy-discharged liquid lands in the dummy discharge receptacle 800 only in the region where the sheet material 510 is not intermediately present.

For example, as illustrated in FIG. 6, the length L1 of the longer direction of the first absorbing member 801 of the dummy discharge receptacle 800 is longer than the length L2 over which the heads 100 are arranged side by side (in the direction orthogonal to the conveying direction). The dummy discharge receptacle 800 is disposed in a relationship that both ends of the first absorbing member 801 protrude from the arrangement of the heads 100. The sheet material 510 has a width W1. When assuming that the sheet material 510 is conveyed in a state that the center of the sheet material 510 meets the center of the dummy discharge receptacle 800, the dummy-discharged liquid lands in the dummy discharge receptacle 800 only at both ends.

Then, along with repeating dummy discharging, there occurs a risk that deposition may grow at both ends of the first absorbing member 801 when a liquid that has a high tendency toward drying and depositing such as a high viscosity liquid is used as the liquid. Hence, for example, replacement is needed.

On the other hand, in the present embodiment, the first absorbing member 801 is divided into a plurality of blocks 811A1 to 811A5 or 811B1 to 811B5 in the direction orthogonal to the conveying direction. Accordingly, depending on presence or absence of facing with the heads 100 and intermediation of the sheet material 510, the blocks are classified into blocks 811 on which the dummy-discharged liquid lands and blocks 811 on which the dummy-discharged liquid does not land.

Likewise, the first absorbing member 801 is divided into a plurality of blocks 811A and 811B in the conveying direction. Accordingly, depending on presence or absence of facing with the heads 100 and intermediation of the sheet material 510, the blocks are classified into blocks 811 on which the dummy-discharged liquid lands and blocks 811 on which the dummy-discharged liquid does not land.

Here, assume that the heads 100, the sheet material 510, and the blocks 811 of the first absorbing member 801 of the dummy discharge receptacle 800 are in the positional relationship illustrated in FIG. 6 and FIG. 7. In this case, the blocks 811 on which the dummy-discharged liquid from the heads 100 lands are only the upstream block 811A1 and the downstream block 811B5.

Accordingly, for replacement of the absorbing member, as illustrated in, for example, FIG. 8, the block 811B5 on which the dummy-discharged liquid lands may be replaced with the block 811A4 on which the dummy-discharged liquid does not land. This makes it possible to set a new absorbing member at the block 811B5. It is also possible to set a separately prepared new block instead of any other block 811 of the same dummy discharge receptacle 800.

Figure 9:
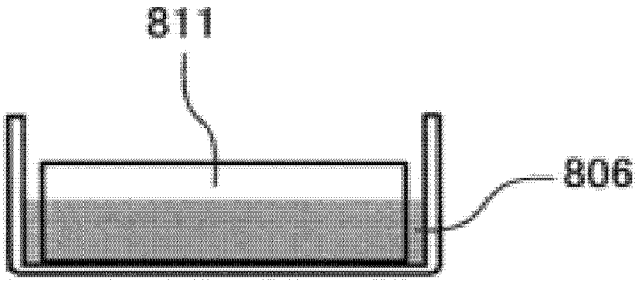
FIG. 9 is a perspective view illustrating an example when impregnating a block of a dummy discharge receptacle of a first embodiment with a humectant liquid.

Next, impregnation of the blocks of the dummy discharge receptacle with a humectant liquid in the present embodiment will be described with reference to also FIG. 9. FIG. 9 is a perspective view illustrating impregnation of a block of the dummy discharge receptacle with a humectant liquid.

It is preferable to impregnate the first absorbing member 801 with a humectant liquid. Impregnation with a humectant liquid makes it possible to suppress drying of the dummy-discharged liquid having landed on the surface of the first absorbing member 801, and suppress growth of deposition.

When the density of the dummy-discharged liquid is lower than the density of the humectant liquid, permeation of the liquid into the first absorbing member 801 is promoted, making it possible to suppress growth of deposition near the surface of the first absorbing member 801.

As the humectant liquid, for example, a washing liquid for an inkjet recording apparatus may be used. Examples of an organic solvent to be added in the washing liquid include polyvalent alcohols of which equilibrium moisture content in the environment of 23 degrees C. and 80% RH is 30% by mass or greater.

Specific examples of the polyvalent alcohols include 1,2,3-butanetriol (38% by mass), 1,2,4-butanetriol (41% by mass), glycerin (49% by mass), diglycerin (38% by mass), triethylene glycol (39% by mass), tetraethylene glycol (37% by mass), diethylene glycol (43% by mass), and 1,3-butanediol (35% by mass). Among these polyvalent alcohols, glycerin and 1,3-butanediol can be particularly suitably used because the viscosity glycerin and 1,3-butanediol can be lowered with addition of water. Use of such a water-soluble organic solvent in an amount of 20% by mass or greater of the total of the processing fluid is preferable because this provides an excellent prevention of adherence of a waste liquid (waste ink).

Here, as described above with reference to FIG. 6 and FIG. 7, in the dummy discharge receptacle 800 of the present embodiment, the blocks 811 on which the dummy-discharged liquid from the heads 100 lands are only the upstream block 811A1 and the downstream block 811B5.

Accordingly, the block 811 may be immersed in the humectant liquid 806 as illustrated in FIG. 9, and the block 811 impregnated with the humectant liquid 806 may be accommodated in the tray 803 as the block 811A1 or the block 811B5.

Likewise, as described above with reference to FIG. 8, for example, when replacing the block 811B5 with the block 811A4, the block 811A4 may be taken out and impregnated with the humectant liquid 806, and subsequently set as the block 811B5.

That is, among the plurality of blocks 811 of the first absorbing member 801, the blocks 811 covering the regions outside the region over which the sheet material 510 passes are impregnated with the humectant liquid 806.

In this way, in replacement of the absorbing member of the dummy discharge receptacle 800 or impregnation with the humectant liquid, block-by-block replacement or block-by-block impregnation with the humectant liquid is possible. This makes it possible to improve the maintenability of the dummy discharge receptacle 800, and save the amount of the absorbing member to be consumed and the amount of the humectant liquid to be consumed.

Figure 10:
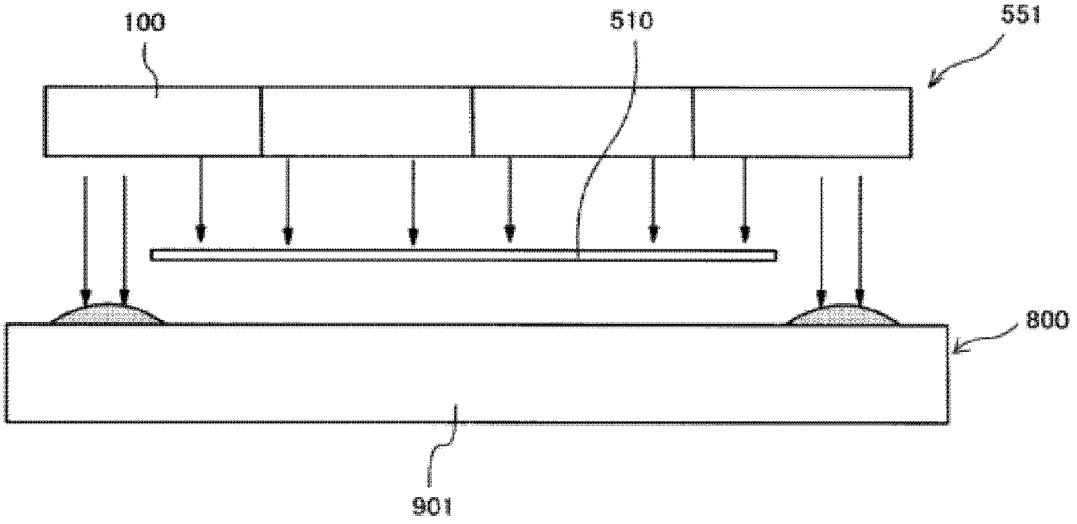
FIG. 10 is a front view illustrating a dummy discharge receptacle of Comparative Example together with heads and a sheet material.

Here, Comparative Example will be described with reference to FIG. 10. FIG. 10 is a front view illustrating the dummy discharge receptacle of the Comparative Example together with heads and a sheet material.

In this Comparative Example, one absorbing member 901 is disposed.

That is, in Comparative Example, the dummy-discharged liquid lands only in the regions at both ends in the direction orthogonal to the conveying direction of the one absorbing member 901. Because one absorbing member 901 is used, the entire absorbing member 901 needs to be replaced or washed. Further, when impregnating the absorbing member 901 with the humectant liquid, the one absorbing member 901 needs to be entirely immersed in the humectant liquid 806.

Hence, in Comparative Example, the maintenance performance of the dummy discharge receptacle is poor, and the amount of the absorbing member to be consumed and the amount of the humectant liquid to be consumed will be wastefully high.

Figure 11:
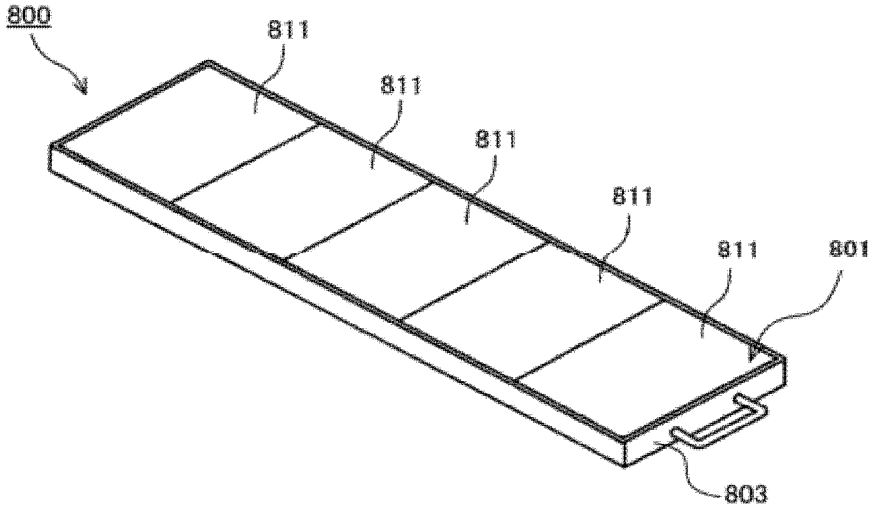
FIG. 11 is a perspective view illustrating an example dummy discharge receptacle of a second embodiment of the present disclosure.

Next, the dummy discharge receptacle of the second embodiment of the present disclosure will be described with reference to FIG. 11. FIG. 11 is a perspective view of the dummy discharge receptacle.

In the present embodiment, the first absorbing member 801 is divided into five independent blocks 811 in the longer direction, but is not divided in the shorter direction.

Also with this configuration, the size of the absorbing member when replacing the absorbing member or impregnating the absorbing member with the humectant liquid is smaller than when one absorbing member is used, making it possible to improve the maintenability of the dummy discharge receptacle 800, and save the amount of the absorbing member to be consumed and the amount of the humectant liquid to be consumed.

Figure 12:
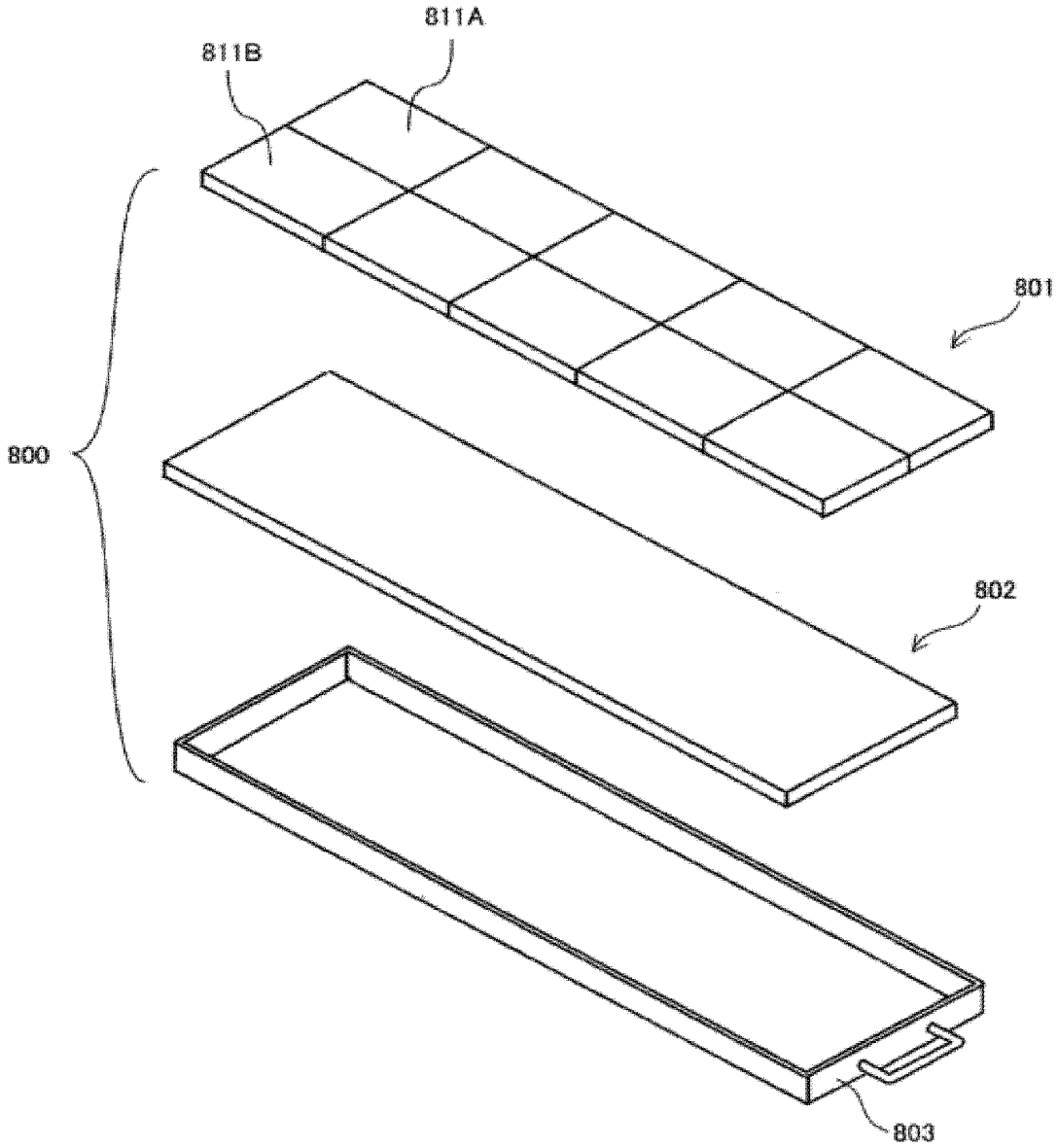
FIG. 12 is an exploded perspective view illustrating an example dummy discharge receptacle of a third embodiment of the present disclosure.
Figure 13:
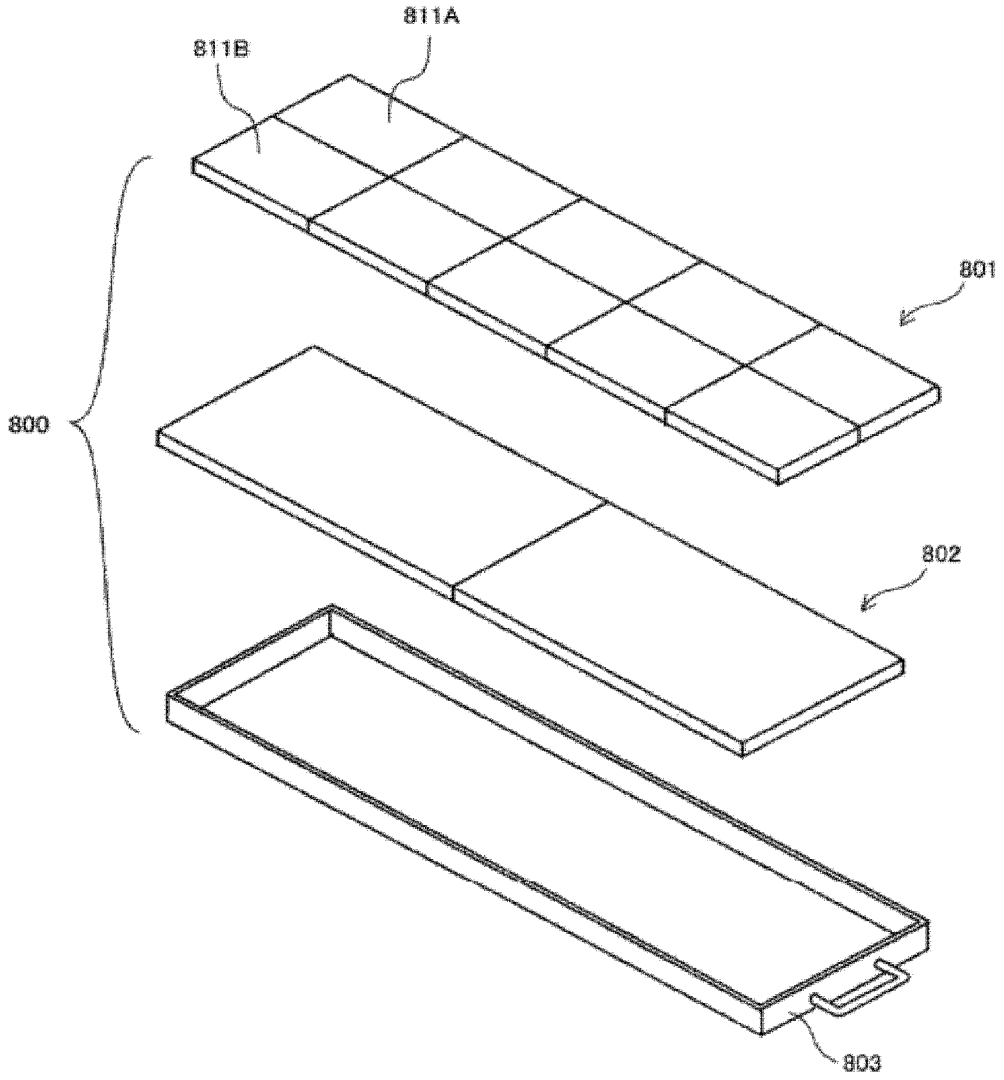
FIG. 13 is an exploded perspective view illustrating another example dummy discharge receptacle of a third embodiment.
Figure 14:
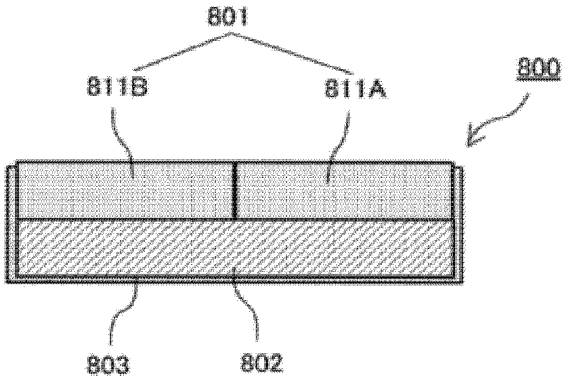
FIG. 14 is a cross-sectional view of an example dummy discharge receptacle of a third embodiment, taken in a shorter direction.
Figure 15:
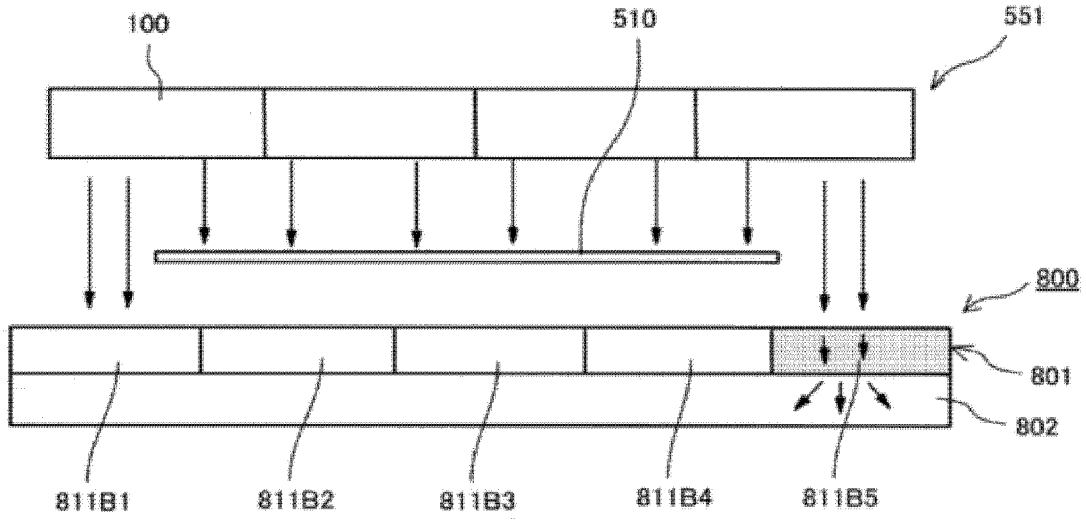
FIG. 15 is a front view illustrating an example positional relationship among a dummy discharge receptacle of a third embodiment, heads, and a sheet material.

Next, the dummy discharge receptacle of the third embodiment of the present disclosure will be described with reference to FIG. 12 to FIG. 15. FIG. 12 is an exploded perspective view of the dummy discharge receptacle. FIG. 13 is an exploded perspective view of the dummy discharge receptacle. FIG. 14 is a cross-sectional view of the dummy discharge receptacle in the shorter direction. FIG. 15 is a front view illustrating an example positional relationship among the dummy discharge receptacle, heads, and a sheet material. The plan view of the positional relationship among the dummy discharge receptacle, heads, and a sheet material is the same as FIG. 6. In FIG. 12, the reference signs of the blocks of the first absorbing member are assigned in a simplified manner.

The dummy discharge receptacle 800 includes a first absorbing member 801 as the upper layer, a second absorbing member 802 as the lower layer, and a tray 803, which is a receptacle member for accommodating the first absorbing member 801 and the second absorbing member 802. The lower layer below the first absorbing member 801 may include two or more layers.

Here, the second absorbing member 802 is not divided but is one absorbing member. However, the second absorbing member 802 may be divided. An example of the second absorbing member when divided is illustrated in FIG. 13. Here, it is preferable that the area of each divided block of the second absorbing member 802 be larger than the area of each block 811 of the first absorbing member 801.

The first absorbing member 801 has a higher liquid permeability and a lower capillary force than the second absorbing member 802, and the second absorbing member 802 has a higher capillary force and a higher liquid retaining capacity than the first absorbing member 801.

For example, a porous body such as melamine foam is used for the first absorbing member 801, and a material such as polyester felt is used for the second absorbing member 802.

This makes it possible to prevent the dummy-discharged liquid (dummy-discharged droplets: waste liquid) from drying and depositing over the first absorbing member 801, and make the dummy-discharged liquid quickly permeate the first absorbing member 801 down to the bottom and flow into the second absorbing member 802.

Then, the second absorbing member 802 can diffuse the liquid received from the first absorbing member 801 in the in-plane direction, to make the liquid contained in the second absorbing member 802 uniform in the in-plane direction of the second absorbing member 802.

For example, as indicated by arrows in FIG. 15, the liquid landing on the block 811B5 of the first absorbing member 801 quickly permeates the first absorbing member 801, and flows into the second absorbing member 802 and diffuses.

In this way, it is possible to increase the amount of printing until when the liquid containable limits of the first absorbing member 801 and the second absorbing member 802 are reached, and reduce the frequency of absorbing member replacement.

For example, by setting the fiber direction of the material of the second absorbing member 802 to be in the in-plane direction, it is possible to improve the capillary force and the diffusing power in the in-plane direction.

In the present embodiment, the positional relationship among the dummy discharge receptacle, the heads, and the sheet material, and the width of the sheet material are the same as in FIG. 6 referred to in the first embodiment. Therefore, the dummy-discharged liquid lands on the upstream block 811A1 and the downstream block 811B5 at both ends of the first absorbing member 801.

Accordingly, the upstream block 811A1 and the downstream block 811B5 at both ends of the first absorbing member 801 are impregnated with the humectant liquid 806.

Figure 16:
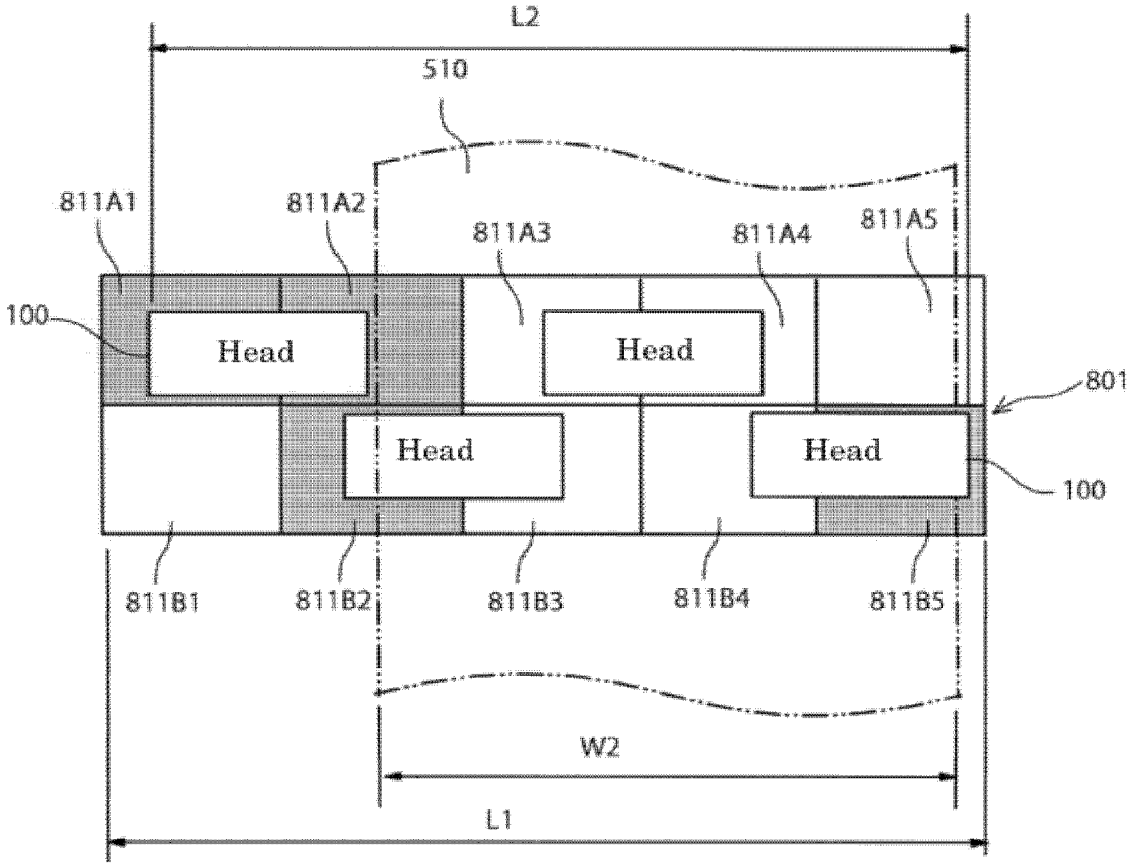
FIG. 16 is a plan view illustrating an example positional relationship among a dummy discharge receptacle of a third embodiment, heads, and a sheet material, for illustrating another example relationship between a sheet material conveying region and blocks to be impregnated with a humectant liquid when a dummy discharge receptacle of a third embodiment is used.
Figure 17:
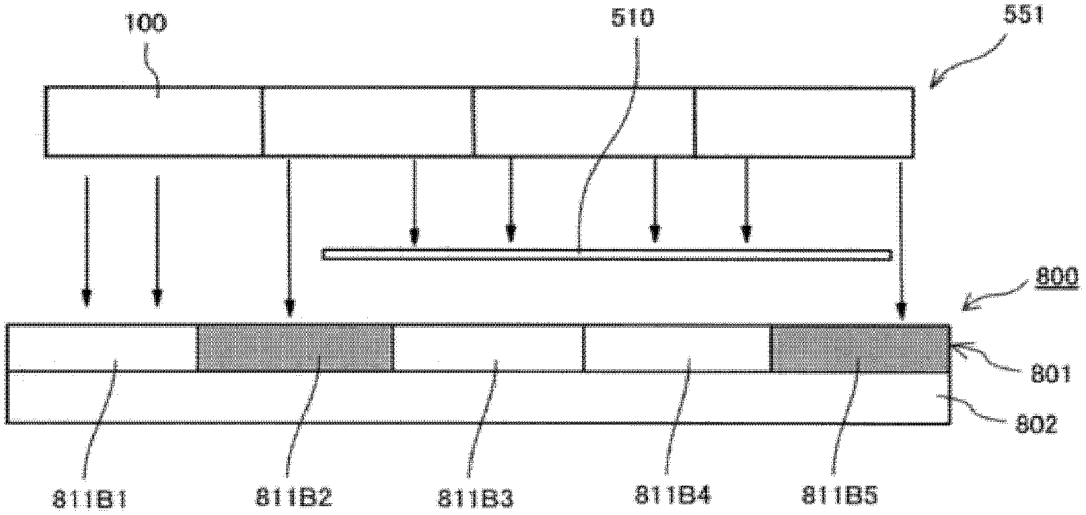
FIG. 17 is a front view illustrating an example dummy discharge receptacle of a third embodiment.

Next, another example of the relationship between the sheet material conveying region and the blocks to be impregnated with the humectant liquid when the dummy discharge receptacle of the third embodiment described above is used will be described with reference to FIG. 16 and FIG. 17. FIG. 16 is a plan view illustrating the positional relationship of the dummy discharge receptacle, the heads, and the sheet material. FIG. 17 is a front view of the same.

In this example, the length L1 of the longer direction of the first absorbing member 801 and the second absorbing member 802 of the dummy discharge receptacle 800 is longer than the length L2 over which the heads 100 are arranged side by side (in the direction orthogonal to the conveying direction), as in FIG. 6. The dummy discharge receptacle 800 is disposed in a relationship that both ends of the first absorbing member 801 and the second absorbing member 802 protrude from the arrangement of the heads 100.

The sheet material 510 has a width W2 (W2<L1), and the sheet material 510 is conveyed in a state that an end of the sheet material 510 meets an end of the dummy discharge receptacle.

Also when the sheet material 510 is conveyed on the end basis, the sheet material 510 is conveyed in a state that the end of the sheet material 510 is inside the end of a head 100.

Therefore, the dummy-discharged liquid lands not only on the upstream blocks 811A1 and 811A2, but also on the downstream block 811B5 at the end and on the block 811B2 that comes to be faced with a head 100 as a result of the one-sided positioning of the sheet material.

Accordingly, in this example, the upstream blocks 811A1 and 811A2 and the downstream block 811B5 at both ends of the first absorbing member 801 and the block 811B2 are impregnated with the humectant liquid 806.

Figure 18:
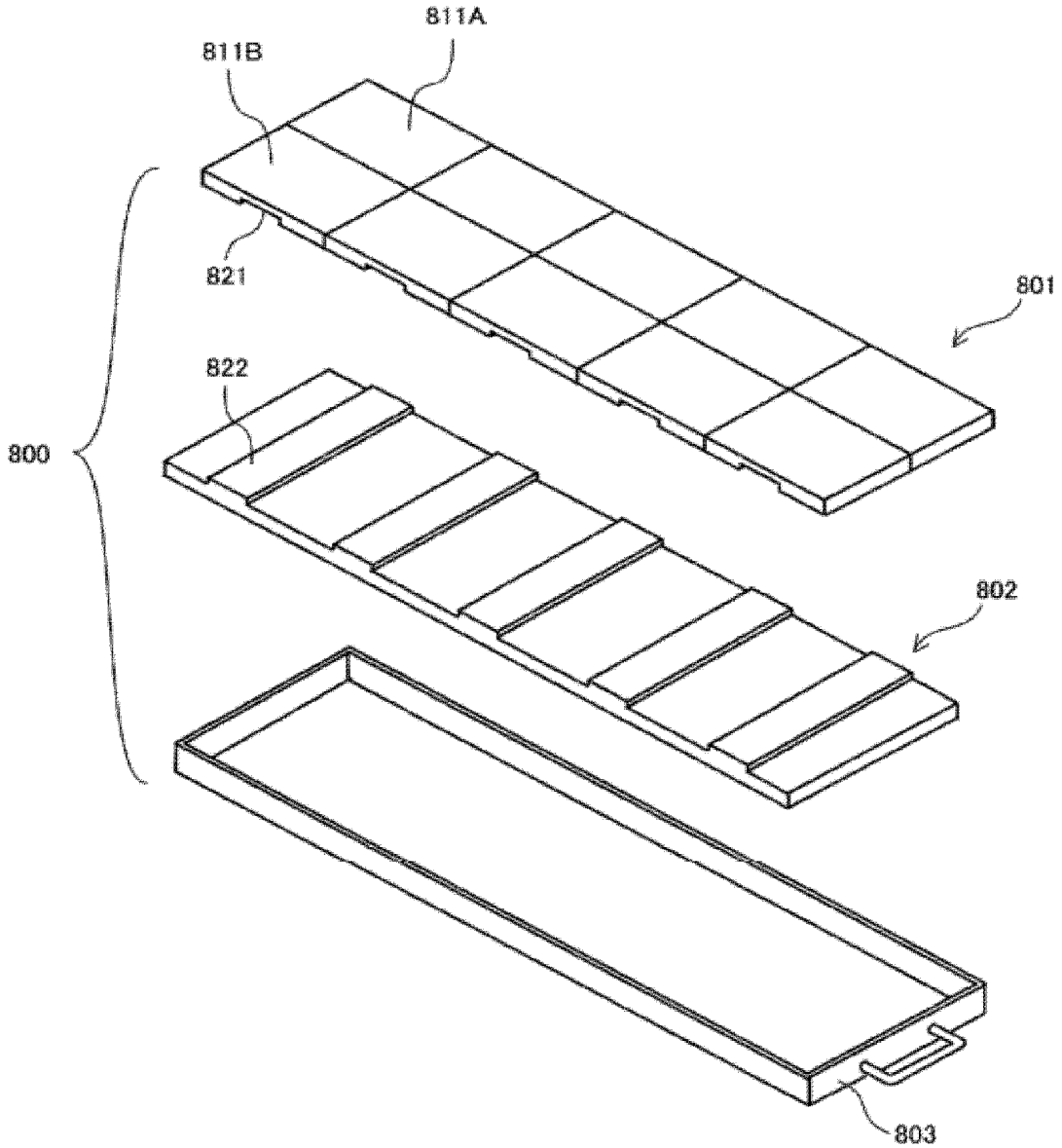
FIG. 18 is an exploded perspective view illustrating an example dummy discharge receptacle of a fourth embodiment of the present disclosure.
Figure 19:
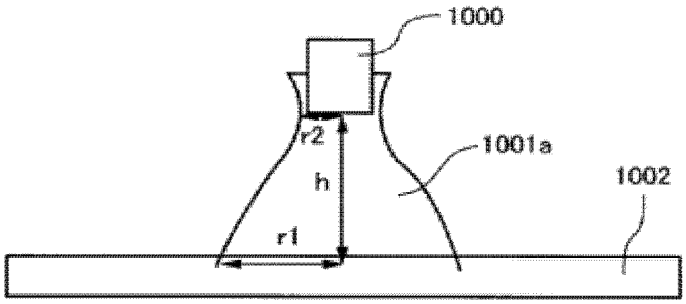
FIG. 19 is a view illustrating an example method for measuring an absorbing speed of an absorbing member (absorber)

Next, the dummy discharge receptacle of the fourth embodiment of the present disclosure will be described with reference to FIG. 18. FIG. 19 is an exploded perspective view of the dummy discharge receptacle.

In the present embodiment, one or more dents 821 are provided in the bottom surface of the first absorbing member 801, and bosses 822 corresponding to the dents 821 of the first absorbing member 801 are provided on the second absorbing member. In this way, the first absorbing member 801 and the second absorbing member 802 are engaged with each other in boss-and-dent engagement.

With the first absorbing member 801 and the second absorbing member 802 engaged with each other by the dents and bosses, the contact area between the first absorbing member 801 and the second absorbing member 802 increases, to improve the efficiency of handover of the liquid from the first absorbing member 801 to the second absorbing member 802.

Furthermore, with the first absorbing member 801 and the second absorbing member 802 engaged by the dents and bosses, the position at which the absorbing members are installed is stabilized, to facilitate installation and enable prevention of a phenomenon that the absorbing members come out of position due to, for example, an air flow that occurs in the apparatus.

It is also possible to provide one or more bosses 822 on the bottom surface of the first absorbing member 801 and provide dents 821 corresponding to the bosses 822 of the first absorbing member 801 in the second absorbing member 802. The number of dents and bosses may be arbitrary, and the direction of the line of the dents or bosses may be any of the sheet conveying direction and the direction orthogonal to the sheet conveying direction.

Next, the characteristics of the first absorbing member 801 when melamine foam (melamine absorber) is used for the first absorbing member 801 will be described.

Use of melamine foam (melamine absorber) for the first absorbing member 801 makes it possible to suppress deposition of the dummy-discharged liquid over the first absorbing member 801. This is because melamine foam has a higher absorbing speed and a lower capillary force than other porous bodies.

Figure 20:
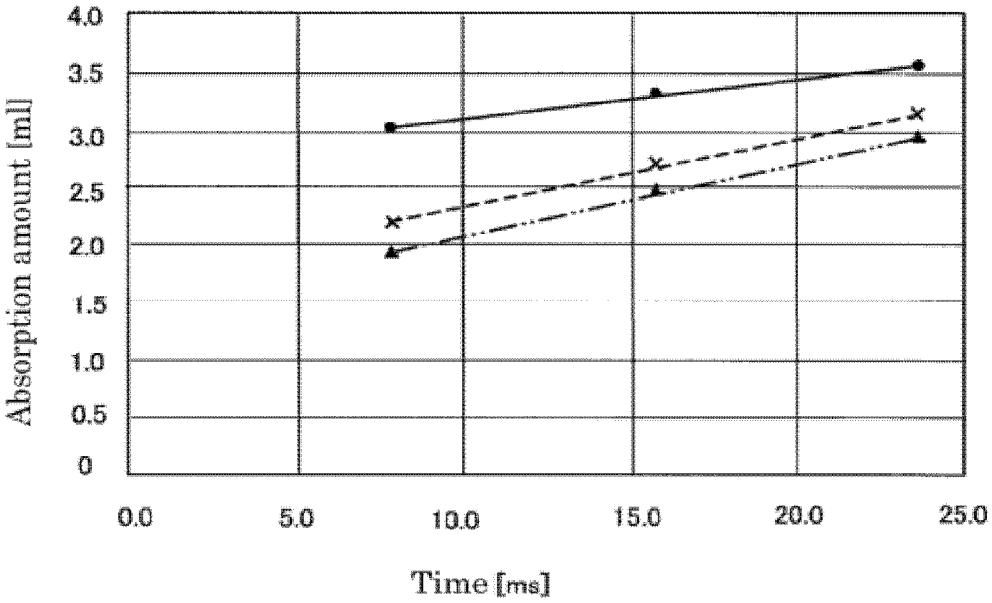
FIG. 20 is a graph for illustrating measuring results of a method for measuring an absorbing speed of an absorbing member (absorber)

Here, measurement of the absorbing speed of the absorbing member (may also be referred to as absorber) will be described with reference to FIG. 19 and FIG. 20. FIG. 19 is a view illustrating a method for measuring the absorbing speed. FIG. 20 is a graph for illustrating the measuring results.

<Procedure of Evaluation>

FIG. 19 should be seen.

(1) An injector filled with an ink 1001 is set on a contact angle meter.

(2) An ink droplet 1001*a* of from 3.5 microliters through 3.8 microliters is formed at the tip of the injection needle 1000.

(3) A sponge (absorber) 1002 to be measured is brought into contact with the ink droplet 1001*a* from below by a manually-operable stage.

(4) The behavior of the ink droplet 1001*a* when absorbed into the absorber 1002 is shot with a high-speed camera.

(5) The time that elapses from the instant the ink droplet 1001*a* and the absorber 1002 come into contact with each other and the absorption amount are plotted, to calculate a dropped ink absorbing speed from the slope. The absorption amount at a certain timing is calculated according to "the initial volume of the ink droplet—the volume of an unabsorbed ink droplet at the certain timing".

<Evaluation Instrument>

[Contact Angle Meter]

Supplier: Data Physics Corporation

Supplier model number: OCA200H

[Injector]

Measuring instrument No.: 02-0144-T

Injection needle: SNS052/026 DOSING NEEDLE (Outer: 0.52 mm/Inner: 0.26 mm/Length: 51 mm)

<Evaluation Conditions>

Ink: an ink described below with a resin content of 5% by mass or greater

Environment: 23 degrees C., 50% RH

Moving image measured: 127 fps

<Calculation of Ink Droplet Volume>

The volume V of the ink droplet that has not been absorbed into the absorber 1002 is calculated based on the shot image.

Here, assuming that the shape of the ink droplet 1001*a* is a truncated cone, the volume V is calculated according to $V=(1/3)-\pi h(r1^2+r1\cdot r2+r2^2)$.

As a result, a graph of the absorption amount vs. time can be obtained as plotted in, for example, FIG. 20. From the slope of the graph, the dropped ink absorbing speed is calculated.

Figure 21:
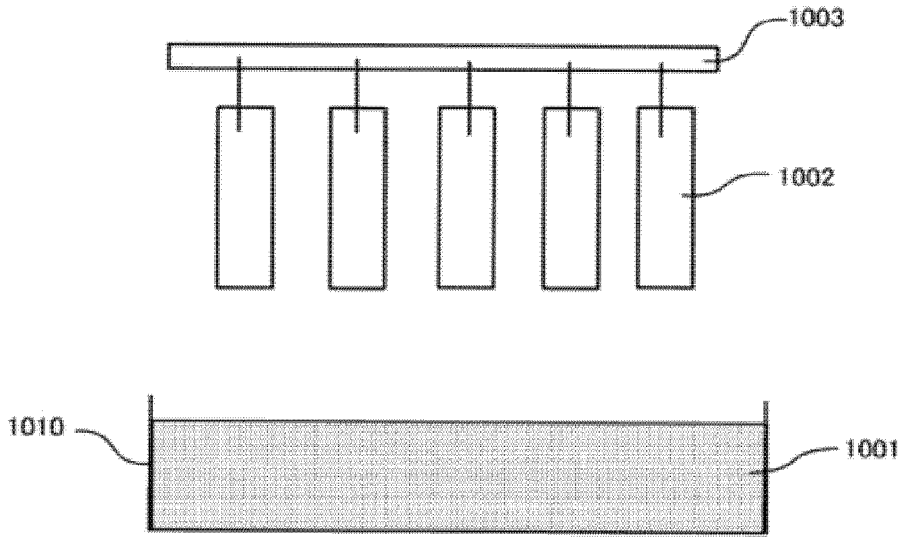
FIG. 21 is a view illustrating an evaluation test for illustrating an example measurement of a capillary force (capillarity) of an absorbing member (absorber)

Next, measurement of the capillary force (capillarity) will be described with reference to FIG. 21. FIG. 21 is a view illustrating an evaluation test for illustrating the measurement.

<Procedure of Evaluation>

(1) The absorbers 1002 are suspended from a supporting member 1003, and the lower ends of the absorbers 1002 are set to the same height position.

(2) An ink pool 1010 containing an ink 1001 is lifted from below.

(3) The ink pool 1010 is fixed at a position at which the ends of the absorbers 1002 are immersed in the ink by about 5 mm.

(4) The ink absorbing height of the absorbers 1002 when 5 minutes has elapsed from when the ends of the absorbers 1002 started to be immersed in the ink 1001 is measured.

(5) The absorbing height [mm] measured is defined as capillary force.

<Evaluation Conditions>

Ink: an ink having a resin content of 5% by mass or greater

Environment: 23 degrees C., 50% RH

Cross-sectional area of absorber: 50 $mm^2$

Depth of ink pool: 10 mm

Figure 22:
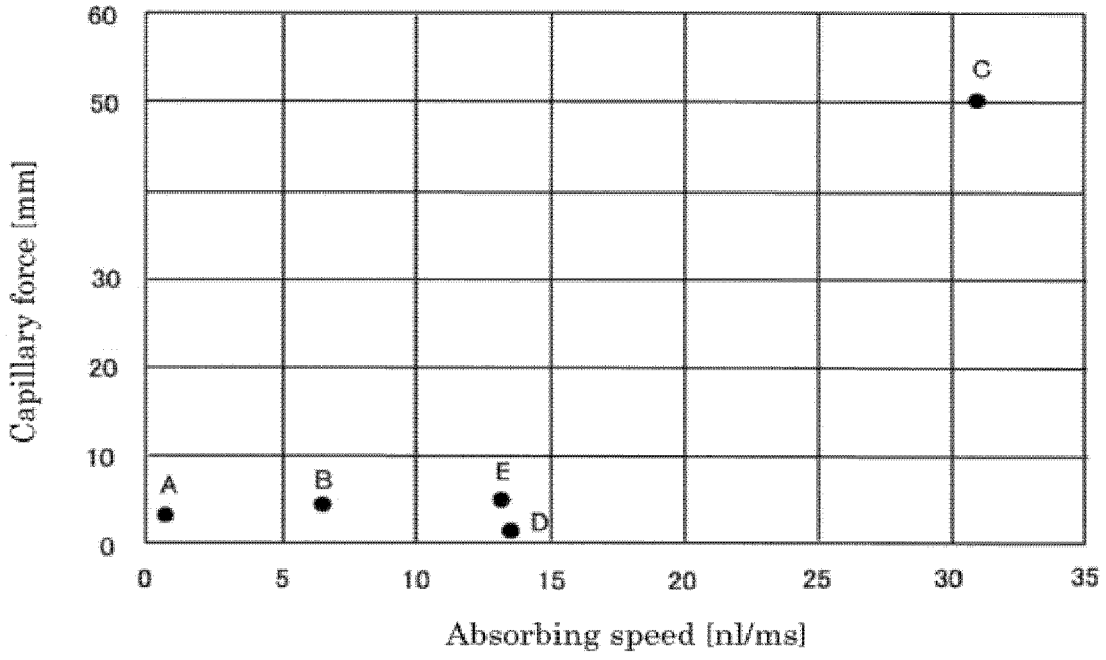
FIG. 22 is a graph plotting an example result of measuring absorbing speeds and capillary forces of absorbers A to E formed of different materials.

The absorbing speed and the capillary force of the following absorbers A to E formed of different materials were measured. The results are plotted in FIG. 22.

A: urethane absorber

B: urethane absorber

C: polyurethane absorber (product name: 5000AZ-P, available from Fujico Co., Ltd.)

D: melamine absorber (melamine sponge; product number: FU491-000X-MB, available from Condor)

E: melamine absorber (BASOTECT (W), available from Inoac Corporation)

Whether ink deposition would occur was confirmed using the absorbing members A to E described above, and using an ink (liquid) having a resin content of 5% by mass or greater.

As a result, ink deposition occurred over absorbers A to C, and no ink deposition occurred over the absorbers D and E.

Hence, it can be seen that no ink deposition occurred over a melamine absorber having characteristic values of higher than 10 nl/ms as the absorbing speed and lower than 10 mm as the capillary force, even when an ink having a resin content of 5% by mass or greater was used.

With a high capillary force (absorbing height), the ink is diffused within the absorber and solidified (formed into a film) within the absorber, making it harder for the ink attached on the surface of the absorber to permeate the inside. Hence, the capillary force (absorbing height) is preferably lower than 10 mm.

As described above, use of melamine foam having a high liquid absorbing speed and a low capillary force as the first absorbing member 801 enables the liquid landing over the surface of the first absorbing member 801 to be quickly absorbed into the first absorbing member and to be diffused in the vertically downward direction without being diffused in the in-plane direction.

Hence, drying does not proceed near the surface of the first absorbing member 801, and even a liquid having a resin content of 5% by mass or greater and hence a high tendency toward deposition is suppressed from being deposited over the surface of the first absorbing member 801.

As a result, the period of regular replacement of the first absorbing member 801 can be lengthened, and the parts cost for replacement and the working fee can be saved.

<Liquid>

Next, the liquid used in the present disclosure will be described in detail. The following description will be given, taking an ink as an example of the liquid. The ink of the present embodiment contains a coloring material, a resin, an organic solvent A, and an organic solvent B, and further contains other components as needed. Use of the ink of the present disclosure is advantageous because the ink is less likely to deposit when dummy-discharged onto the absorbing member.

—Organic Solvent A—

The organic solvent A used in the present embodiment is preferably alkyl alkanediol having alkanediol containing 3 through 6 carbon atoms as a main chain and an alkyl group containing 1 through 2 carbon atoms as a branched chain.

The alkyl alkanediol has a fine balance between hydrophilic group and hydrophobic group, and is water-soluble and hydrophobic group-rich. Therefore, the alkyl alkanediol can promote permeation of into a recording medium.

Particularly preferable examples of the alkyl alkanediol include 2-methyl-1,3-propanediol (bp: 214 degrees C.), 3-methyl-1,3-butanediol (bp: 203 degrees C.), 3-methyl-1,5-pentanediol (bp: 250 degrees C.), and 2-ethyl-1,3-hexahediol (bp: 243.2 degrees C.).

—Organic Solvent B—

The organic solvent B used in the present embodiment is preferably a polyvalent alcohol having an equilibrium moisture content of 30% by mass or greater at a relative humidity of 80%, and a saturated vapor pressure of 20 mmHg or higher at 100 degrees C.

Because of the high equilibrium moisture content, the polyvalent alcohol can improve the moisture retaining property of the liquid, maintain the viscosity at a low level in the event of moisture evaporation, and suppress deposition of the liquid. Moreover, because of the saturated vapor pressure of 20 mmHg or higher at 100 degrees C., the polyvalent alcohol tends not to inhibit drying of a printed matter.

Particularly preferable examples of the polyvalent alcohol include 1,2-propanediol (49%/23 mmHg) and 1,3-butanediol (35%/20 mmHg). The values in the parentheses indicate the equilibrium moisture content at the relative humidity of 80% and the saturated vapor pressure at 100 degrees C.

In the present embodiment, the equilibrium moisture content of the compound at the relative humidity of 80% is the moisture content at which equilibrium is established, obtained in the manner described below.

A petri dish into which each organic solvent is weighed out by 1 g is stored in a desiccator in which the temperature is maintained at 23±1 degrees C. and the relative humidity is maintained at 80±3% using a potassium chloride/sodium chloride saturated aqueous solution. Then, the moisture content at which equilibrium is established is calculated according to the mathematical formula (1) below.

$$\text{Equilibrium moisture content (\%)} = \frac{\text{moisture content absorbed into organic solvent}}{\left(\begin{array}{c}\text{organic solvent content} + \\ \text{moisture content absorbed} \\ \text{into organic solvent}\end{array}\right)} \times 100 \qquad \text{Mathematical formula (1)}$$

The saturated vapor pressure of the compound at 100 degrees C. can be measured by, for example, a DSC method (differential scanning calorimetry method).

—Ratio by Mass (A/B) Between Organic Solvent a and Organic Solvent B—

The ratio by mass (A/B) between the content (% by mass) of the organic solvent A and the content (% by mass) of the organic solvent B in the liquid used in the present embodiment is preferably 1 or less.

When the ratio by mass (A/B) is 1 or less, the moisture retaining property of the liquid can be improved. Hence, the dummy-discharged liquid can be suppressed from being dried and solidified.

The total content (% by mass) of the organic solvent A and the organic solvent B in the liquid is preferably 1% by mass or greater but 50% by mass or less and more preferably 5% by mass or greater but 40% by mass or less.

—Organic Solvent C—

By further adding an organic solvent C having a solubility parameter of 9 or greater but 11 or less in the liquid used in the present embodiment, it is possible to improve wettability over a recording medium. This also enables the liquid component to permeate even commercial printing paper having a coating layer and hence having a poor liquid absorbability such as coat paper and improve image quality. Moreover, the organic solvent C, and the organic solvent A and the organic solvent B have a high compatibility as compounds when mixed with each other, and do not inhibit each other's functions.

When moisture is evaporated from the liquid and the liquid comes to have a composition rich in the organic solvent C, hydrophobicity of the liquid increases, to degrade the dispersion stability of the coloring material and the resin and cause a risk of acceleration of deposition. Taking these factors into consideration, the content of the organic solvent C in the liquid is preferably 1% by mass or greater but 40% by mass or less. With the content of organic solvent C falling within the preferable range, it is possible to improve image quality while suppressing drying and solidification of the liquid.

Generally, the solubility parameter (SP value) is widely used as an indicator of affinity and solubility of materials such as solvents, resins, and pigments that are used being dissolved or dispersed in water or a solvent.

As the method for obtaining the SP value, various methods have been proposed, such as an experimentally measuring method, a calculation method based on measurement of physical properties such as immersion heat, and a calculation method based on molecular structure. In the present embodiment, a calculation method based on molecular structure, proposed by Fedors, is used. This method is effective because the method can calculate SP values so long as molecular structures are known and has a small difference from measured values obtained by experiment.

According to the Fedors method, it is possible to obtain a SP value by assigning the evaporation energy Δei and the molar volume Δvi of each atom or each group of atoms at 25 degrees C. in the mathematical formula (2) below. In the present embodiment, SP values at 25 degrees C. are used, and, for example, temperature correction is not performed.

The data described in Imoto, Minoru. SECCHAKU NO KISO RIRON, Kobunshi Kankokai, chapter 5 can be used as the data for the evaporation energy Δei and the molar volume Δvi of each group of atoms in the calculation method. Fedors, R. F. *Polym. Eng. Sci.* 14, 147, 1974 can be referred to for any substances, of which data are not presented in SECCHAKU NO KISO R/RONmentioned above.

$$SP\ \text{value}\left(\frac{\Delta E}{V}\right)^{1/2} = \left(\frac{\Sigma_i \Delta ei}{\Sigma_i \Delta vi}\right)^{1/2} \qquad \text{Mathematical formula (2)}$$

In the mathematical formula (2), ΔE represents evaporation energy, V represents molar volume, $\Delta_{ei}$ represents evaporation energy of an atom or a group of atoms, and ΔVi represents molar volume of an atom or a group of atoms.

Examples of compounds having SP values of 9 or greater but 11 or less include N,N-dimethyl-6-butoxypropionamide (SP value: 9.8), N,N-dimethyl-6-ethoxypropionamide (SP value: 9.8), and 3-ethyl-3-hydroxymethyloxetane (SP value: 10.7). One of these compounds may be used alone or two or more of these compounds may be used in combination.

The structural formulae of N,N-dimethyl-6-butoxypropionamide, N,N-dimethyl-6-ethoxypropionamide, and 3-ethyl-3-hydroxymethyloxetane mentioned above are presented below. The structural formula (1) represents N,N-dimethyl-6-butoxypropionamide, the structural formula (2) represents N,N-dimethyl-6-ethoxypropionamide, and the structural formula (3) represents 3-ethyl-3-hydroxymethyloxetane.

Structural formula (1)

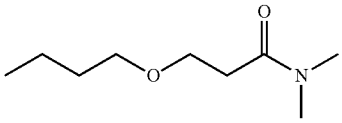

Structural formula (2)

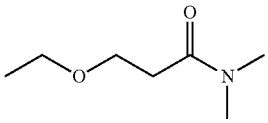

Structural formula (3)

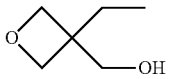

—Copolymer Having Specific Structure—

A copolymer having a specific structure and suitable for use in the present embodiment will be described.

When moisture is evaporated from the dummy-discharged liquid, there occurs a problem that the liquid changes to a hydrophobic composition, and the changed balance between hydrophilicity and hydrophobicity spoils the dispersion stability of the pigment contained in the liquid. When the dispersion stability of the pigment is spoiled, the liquid is likely to thicken and deposit.

In this regard, in the present embodiment, it is preferable to add a copolymer having a structural unit represented by the general formula (1) below. As compared with typical copolymers, the copolymer having the structural unit represented by the general formula (1) below can stably disperse a pigment contained in an ink even in such a hydrophobic ink solvent. The reason for which such an excellent solvent resistance as described above is expressed is considered to be that a naphthyl group in a side chain of the general formula (1) below in the copolymer more strongly adsorbs to the pigment by hydrophobic interaction.

General formula (1)

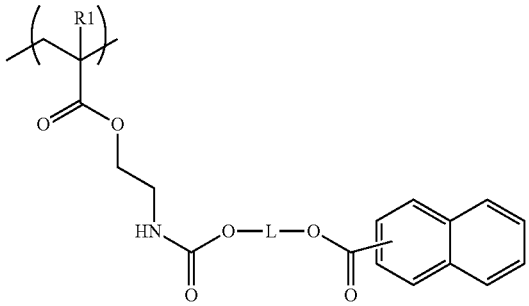

In the general formula (1), R1 represents a hydrogen atom or a methyl group, and L represents an alkylene group containing 2 or more but 18 or less carbon atoms.

The content ratio of the structural unit represented by the general formula (1) above in the copolymer is preferably 10 mol % or greater but 90 mol % or less, and more preferably 30 mol % or greater but 70 mol % or less. When the content ratio of the structural unit represented by the general formula (1) is 30 mol % or greater but 70 mol % or less, it is possible to improve the dispersion stability of the pigment in the liquid and better suppress deposition of the liquid.

The content ratio of the copolymer having the structural unit represented by the general formula (1) in the liquid is preferably 0.1% by mass or greater but 10.0% by mass or less, and more preferably 0.5% by mass or greater but 5.0% by mass or less. When the content ratio of the copolymer is in the preferable range, it is possible to maintain the viscosity at a low level in the event of moisture evaporation and better suppress deposition of the liquid.

The copolymer is obtained by polymerizing the monomer represented by the general formula (2) below with, for example, a polymerizable monomer containing an anionic hydrophilic functional group, a polymerizable hydrophobic monomer, or a polymerizable surfactant. As needed, a polymerizable monomer having a hydrophilic functional group other than an anionic hydrophilic functional group, such as a polymerizable monomer having a cationic hydrophilic functional group or a polymerizable monomer having a nonionic hydrophilic functional group may be added.

General formula (2)

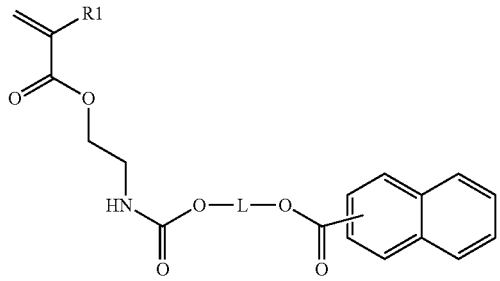

In the general formula (2), R1 represents a hydrogen group or a methyl group, and L represents an alkylene group containing 2 or more but 18 or less carbon atoms.

The monomer represented by the general formula (2) can be synthesized using, for example, a hitherto known monomer such as 1-vinylnaphthalene and 2-vinylnaphthalene.

The monomer represented by the general formula (2) can also be obtained by allowing a reactive compound containing a naphthyl group in the molecule to undergo reaction with a polymerizable monomer.

Examples of the reactive compound containing a naphthyl group in the molecule include naphthalene carboxylic acid hydroxyethyl ester, naphthalene carboxylic acid hydroxypropyl ester, and naphthalene carboxylic acid hydroxybutyl ester.

Examples of the monomer to be reacted with these reactive compounds include 2-acryloyloxyethyl isocyanate and 2-methacryloylethyl isocyanate.

Examples of the polymerizable monomer containing an anionic hydrophilic functional group include: unsaturated carboxylic acids such as acrylic acid, methacrylic acid, maleic acid, and itaconic acid; unsaturated phosphoric acids such as 2-methacryloyloxyethyl acid phosphate, 2-acryloyloxyethyl acid phosphate, acid phosphoxypolyoxyethylene glycol methacrylate, and acid phosphoxypoly(oxyethyleneoxypropylene)glycol methacrylate; unsaturated sulfonic acids such as vinylsulfonic acid, styrenesulfonic acid, 4-styrenesulfonic acid, 2-acrylamide-2-methylpropanesulfonic acid, and 2-hydroxy-3-allyloxy-1-propanesulfonic acid; and anionic unsaturated ethylene monomers such as unsaturated ethylene monomers containing phosphoric acid, phosphonic acid, alendronic acid, or etidronic acid.

It is preferable that the copolymer of the present embodiment contain an anionic hydrophilic functional group. Examples of the anionic hydrophilic functional group include, but are not limited to, the followings. [Examples of anionic hydrophilic functional groups]

$—COO^-$, $—SO_3^-$, $—PO_3H^-$, $—PO_3^{2-}$, $—CON^{2-}$, $—SO_3N^{2-}$, $—NHC_6H_4—COO^-$, $—NH—C_6H_4—SO_3^-$, $—NH—C_6H_4—PO_3H^-$, $—NH—C_6H_4—PO_3^{2-}$, $—NH—C_6H_4—CON^{2-}$, and $—NH—C_6H_4—SO_3N^{2-}$ Among these anionic hydrophilic functional groups, a carboxyl group is particularly preferable. When the anionic hydrophilic functional group is a carboxyl group, the dispersion stability of the pigment is improved and the deposition property of the ink is improved.

As described below, it is preferable that the copolymer be a salt. When a base is added in order to neutralize the copolymer, the added base is present as a cation.

Examples of the polymerizable hydrophobic monomer include: unsaturated ethylene monomers having an aromatic ring such as α-methylstyrene, 4-t-butylstyrene, and 4-chloromethylstyrene; alkyl (meth)acrylates such as methyl (meth)acrylate, ethyl (meth)acrylate, (meth)acrylic acid-n-butyl, dimethyl maleate, dimethyl itaconate, dimethyl fumarate, lauryl (meth)acrylate (C12), tridecyl (meth)acrylate (C13), tetradecyl (meth)acrylate (C14), pentadecyl (meth)acrylate (C15), hexadecyl (meth)acrylate (C16), heptadecyl (meth)acrylate (C17), nonadecyl (meth)acrylate (C19), eicosyl (meth)acrylate (C20), heneicosyl (meth)acrylate (C21), and docosyl (meth)acrylate (C22); and unsaturated ethylene monomers containing an alkyl group, such as 1-heptene, 3,3-dimethyl-1-pentene, 4,4-dimethyl-1-pentene, 3-methyl-1-hexene, 4-methyl-1-hexene, 5-methyl-1-hexene, 1-octene, 3,3-dimethyl-1-hexene, 3,4-dimethyl-1-hexene, 4,4-dimethyl-1-hexene, 1-nonene, 3,5,5-trimethyl-1-hexene, 1-decene, 1-undecene, 1-dodecene, 1-tridecene, 1-tetradecene, 1-pentadecene, 1-hexadecene, 1-heptadecene, 1-octadecene, 1-nonadecene, 1-eicosen, and 1-docosene. One of these polymerizable hydrophobic monomers may be used alone or two or more of these polymerizable hydrophobic monomers may be used in combination.

The polymerizable surfactant is an anionic or nonionic surfactant containing at least one or more radical-polymerizable unsaturated double-bond groups in the molecule.

Examples of the anionic surfactant include: hydrocarbon compounds containing a sulfuric acid base such as an ammonium sulfate base ($—SO_3^-NH_4^+$) and an allyl group ($—CH_2—CH=CH_2$); hydrocarbon compounds containing a sulfuric acid base such as an ammonium sulfate base ($—SO_3^-NH_4^+$) and a methacrylic group [$—CO—C(CH_3)=CH_2$]; and aromatic hydrocarbon compounds containing a sulfuric acid base such as ($—SO_3^-NH_4^+$) and a 1-propenyl group ($—CH=CH_2CH_3$).

Specific examples of the anionic surfactant include: ELEMINOL JS-20 and RS-300 available from Sanyo Chemical Industries, Ltd.; and AQUALON KH-10, AQUALON KH-1025, AQUALON KH-05, AQUALON HS-10, AQUALON HS-1025, AQUALON BC-0515, AQUALON BC-10, AQUALON BC-1025, AQUALON BC-20, and AQUALON BC-2020 available from DKS Co., Ltd.

Examples of the nonionic surfactant include hydrocarbon compounds or aromatic hydrocarbon compounds containing a 1-propenyl group ($—CH=CH_2CH_3$) and a polyoxyethylene group [$—(C_2H_4O)_n^-H$]. Specific examples of the nonionic surfactant include: AQUALON RN-20, AQUALON RN-2025, AQUALON RN-30, and AQUALON RN-50 available from DKS Co., Ltd.; and LATEMUL PD-104, LATEMUL PD-420, LATEMUL PD-430, and LATEMUL PD-450 available from Kao Corporation.

One of these polymerizable surfactants may be used alone or two or more of these polymerizable surfactants may be used as a mixture.

Examples of the polymerizable monomer having a nonionic hydrophilic functional group include (meth)acrylic acid-2-hydroxyethyl, diethylene glycol mono(meth)acrylate, triethylene glycol mono(meth)acrylate, tetraethylene glycol mono(meth)acrylate, and polyethylene glycol mono (meth)acrylate.

Examples of the polymerizable monomer having a cationic hydrophilic functional group include (meth)acrylamide, N-methylol(meth)acrylamide, N-vinylformamide, N-vinylacetamide, N-vinylpyrrolidone, acrylamide, N,N-dimethylacrylamide, N-t-butylacrylamide, N-octylacrylamide, and Nt-octylacrylamide.

As the method for synthesizing the copolymer, various known synthesizing methods such as solution polymerization, suspension polymerization, bulk polymerization, and emulsion polymerization can be used. A method using a radical polymerization initiator is preferable because a polymerization operation and molecular weight adjustment are easy.

As the radical polymerization initiator, a commonly used one may be used. Specific examples of the radical polymerization initiator include peroxyketal, hydroperoxide, dialkyl peroxide, diacyl peroxide, peroxydicarbonate, peroxyester, cyano-based azobisisobutyronitrile, azobis(2-methylbutyronitrile), azobis(2,2'-isovaleronitrile), and noncyano-based dimethyl-2,2'-azobisisobutyrate. Organic peroxides and azo-based compounds of which molecular weight is easily controllable and that have a low decomposition temperature are preferable. Azo-based compounds are particularly preferable. The amount of use of the polymerization initiator is preferably from 1% by mass through 10% by mass relative to the total mass of the polymerizable monomer.

The weight average molecular weight of the copolymer is preferably 5,000 or greater but 40,000 or less.

In the present embodiment, it is preferable that the copolymer be a salt. A base added in order to neutralize the copolymer is present as a cation in the ink.

The addition amount of the cation is preferably 1 time or greater but 2 times or less greater than the number of moles of the anionic hydrophilic functional group contained in the copolymer, because the storage stability of a pigment dispersion and the storage stability of the ink are better improved.

The cation is preferably an organic ammonium ion because the storage stability of the ink is better improved.

The cation is not particularly limited. Examples of the cation include sodium ion, potassium ion, lithium ion, and organic ammonium ion.

Examples of the organic ammonium ion include tetramethyl ammonium ion, tetraethyl ammonium ion, tetrapropyl ammonium ion, tetrabutyl ammonium ion, tetrapentyl ammonium ion, tetrahexyl ammonium ion, triethylmethyl ammonium ion, tributylmethyl ammonium ion, trioctylmethyl ammonium ion, 2-hydroxyethyltrimethyl ammonium ion, tris(2-hydroxyethyl)methyl ammonium ion, propyltrimethyl ammonium ion, hexyltrimethyl ammonium ion, octyltrimethyl ammonium ion, nonyltrimethyl ammonium ion, decyltrimethyl ammonium ion, dodecyltrimethyl ammonium ion, tetradecyltrimethyl ammonium ion, hexadecyltrimethyl ammonium ion, octadecyltrimethyl ammonium ion, didodecyldimethyl ammonium ion, ditetradecyldimethyl ammonium ion, dihexadecyldimethyl ammonium ion, dioctadecyldimethyl ammonium ion, ethylhexadecyldimethyl ammonium ion, ammonium ion, dimethyl ammonium ion, trimethyl ammonium ion, monoethyl ammonium ion, diethyl ammonium ion, triethyl ammonium ion, monoethanol ammonium ion, diethanol ammonium ion, triethanol ammonium ion, methylethanol ammonium ion, methyldiethanol ammonium ion, dimethylethanol ammonium ion, monopropanol ammonium ion, dipropanol ammonium ion, tripropanol ammonium ion, and isopropanol ammonium ion.

—Other Organic Solvents—

Other organic solvents than described above may also be used. Other organic solvents are not particularly limited, and water-soluble organic solvents may be used. Examples of water-soluble organic solvents include polyvalent alcohols, ethers such as polyvalent alcohol alkylethers and polyvalent alcohol arylethers, nitrogen-containing heterocyclic compounds, amides, amines, and sulfur-containing compounds.

Specific examples of the polyvalent alcohols include ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and petriol.

Examples of the polyvalent alcohol alkylethers include ethylene glycol monoethylether, ethylene glycol monobutylether, diethylene glycol monomethylether, diethylene glycol monoethylether, diethylene glycol monobutylether, tetraethylene glycol monomethylether, and propylene glycol monoethylether.

Examples of the polyvalent alcohol arylethers include ethylene glycol monophenylether and ethylene glycol monobenzylether.

Examples of the nitrogen-containing heterocyclic compounds include 2-pyrrolidone, N-methyl-2-pyrrolidone, N-hydroxyethyl-2-pyrrolidone, 1,3-dimethyl-2-imidazolidinone, ε-caprolactam, and γ-butyrolactone.

Examples of the amides include formamide, N-methylformamide, N,N-dimethylformamide, 3-methoxy-N,N-dimethylpropionamide, and 3-butoxy-N,N-dimethylpropionamide.

Examples of the amines include monoethanolamine, diethanolamine, and trimethylamine.

Examples of the sulfur-containing compounds include dimethyl sulfoxide, sulfolane, and thiodiethanol.

Examples of the organic solvents include propylene carbonate and ethylene carbonate.

Use of an organic solvent having a boiling point of 250 degrees C. or lower is preferable because such an organic solvent not only functions as a humectant but also provides a good drying property.

Polyol compounds having eight or more carbon atoms and glycol ether compounds are also suitable as an organic solvent. Specific examples of the polyol compounds having eight or more carbon atoms include, but are not limited to, 2-ethyl-1,3-hexanediol and 2,2,4-trimethyl-1,3-pentanediol.

Specific examples of the glycolether compounds include, but are not limited to, polyol alkylethers such as ethyleneglycol monoethylether, ethyleneglycol monobutylether, diethylene glycol monomethylether, diethyleneglycol monoethylether, diethyleneglycol monobutylether, tetraethyleneglycol monomethylether, and propylene glycol monoethylether; and polyol arylethers such as ethyleneglycol monophenylether and ethyleneglycol monobenzylether.

The polyol compounds having eight or more carbon atoms and glycolether compounds enhance the permeability of ink when paper is used as a recording medium.

The content of the organic solvent in ink has no particular limit and can be suitably selected to suit a particular application.

In terms of the drying property and discharging reliability of the ink, the content is preferably from 10 through 60 percent by mass and more preferably from 20 through 60 percent by mass.

<Water>

The content of water in the ink has no particular limit and can be suitably selected to suit to a particular application. In terms of the drying property and discharging reliability of the ink, the content is preferably from 10 through 90 percent by mass and more preferably from 20 through 60 percent by mass.

<Coloring Material>

The coloring material has no particular limit. For example, pigments and dyes are suitable.

The pigment includes inorganic pigments and organic pigments. These can be used alone or in combination. In addition, it is possible to use a mixed crystal.

As the pigments, for example, black pigments, yellow pigments, magenta pigments, cyan pigments, white pigments, green pigments, orange pigments, gloss pigments of gold, silver, etc., and metallic pigments can be used.

As the inorganic pigments, in addition to titanium oxide, iron oxide, calcium carbonate, barium sulfate, aluminum hydroxide, barium yellow, cadmium red, and chrome yellow, carbon black manufactured by known methods such as contact methods, furnace methods, and thermal methods can be used.

As the organic pigments, it is possible to use azo pigments, polycyclic pigments (phthalocyanine pigments, perylene pigments, perinone pigments, anthraquinone pigments, quinacridone pigments, dioxazine pigments, indigo pigments, thioindigo pigments, isoindolinone pigments, and quinophthalone pigments, etc.), dye chelates (basic dye type chelates, acid dye type chelates, etc.), nitro pigments, nitroso pigments, and aniline black. Of these pigments, pigments having good affinity with solvents are preferable. Also, hollow resin particles and inorganic hollow particles can be used.

Specific examples of the pigments for black include, but are not limited to, carbon black (C.I. Pigment Black 7) such as furnace black, lamp black, acetylene black, and channel black, metals such as copper, iron (al. Pigment Black 11), and titanium oxide, and organic pigments such as aniline black (C.I. Pigment Black 1).

Specific examples of the pigments for color include, but are not limited to, C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2 (Permanent Red 2B(Ca)), 48:3, 48:4, 49:1, 52:2, 53:1, 57:1 (Brilliant Carmine 6B), 60:1, 63:1, 63:2, 64:1, 81, 83, 88, 101 (rouge), 104, 105, 106, 108 (Cadmium Red), 112, 114, 122 (Quinacridone Magenta), 123, 146, 149, 166, 168, 170, 172, 177, 178, 179, 184, 185, 190, 193, 202, 207, 208, 209, 213, 219, 224, 254, and 264; C.I. Pigment Violet 1 (Rhodamine Lake), 3, 5:1, 16, 19, 23, and 38; C.I. Pigment Blue 1, 2, 15 (Phthalocyanine Blue), 15:1, 15:2, 15:3, 15:4 (Phthalocyanine Blue), 16, 17:1, 56, 60, and 63; and C.I. Pigment Green 1, 4, 7, 8, 10, 17, 18, and 36.

The type of dye is not particularly limited and includes, for example, acidic dyes, direct dyes, reactive dyes, and basic dyes. These can be used alone or in combination.

Specific examples of the dye include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The content of the coloring material in ink is preferably from 0.1 through 15 percent by mass and more preferably from 1 through 10 percent by mass in terms of enhancement of image density, fixability, and discharging stability.

To obtain the ink, the pigment is dispersed by, for example, preparing a self-dispersible pigment by introducing a hydrophilic functional group into the pigment, coating the surface of the pigment with resin, or using a dispersant.

To prepare a self-dispersible pigment by introducing a hydrophilic functional group into a pigment, for example, it is possible to add a functional group such as sulfone group and carboxyl group to the pigment (e.g., carbon) to disperse the pigment in water.

To coat the surface of the pigment with resin, the pigment is encapsulated by microcapsules to make the pigment dispersible in water. This can be referred to as a resin-coated pigment. In this case, the pigment to be added to ink is not necessarily wholly coated with resin. Pigments partially or wholly uncovered with resin may be dispersed in the ink unless the pigments have an adverse impact.

To use a dispersant, for example, a known dispersant of a small molecular weight type or a high molecular weight type represented by a surfactant is used to disperse the pigments in ink.

As the dispersant, it is possible to use, for example, anionic surfactants, cationic surfactants, nonionic surfactants, amphoteric surfactants, etc. depending on the pigments.

Also, a nonionic surfactant (RT-100, manufactured by TAKEMOTO OIL & FAT CO., LTD.) and a formalin condensate of naphthalene sodium sulfonate are suitable as dispersants.

These dispersants can be used alone or in combination.

<Pigment Dispersion>

The ink can be obtained by mixing a pigment with materials such as water and organic solvent. It is also possible to mix a pigment with water, a dispersant, etc., first to prepare a pigment dispersion and thereafter mix the pigment dispersion with materials such as water and organic solvent to manufacture ink.

The pigment dispersion is obtained by mixing and dispersing water, pigment, pigment dispersant, and other optional components and adjusting the particle diameter. It is good to use a dispersing device for dispersion.

The particle diameter of the pigment in the pigment dispersion has no particular limit. For example, the maximum frequency in the maximum number conversion is preferably from 20 through 500 nm and more preferably from 20 through 150 nm to improve dispersion stability of the pigment and ameliorate the discharging stability and image quality such as image density. The particle diameter of the pigment can be measured using a particle size analyzer (Nanotrac Wave-UT151, manufactured by MicrotracBEL Corp).

In addition, the content of the pigment in the pigment dispersion is not particularly limited and can be suitably selected to suit a particular application. In terms of improving discharging stability and image density, the content is preferably from 0.1 through 50 percent by mass and more preferably from 0.1 through 30 percent by mass.

During the production, coarse particles are optionally filtered off from the pigment dispersion with a filter, a centrifuge, etc. preferably followed by degassing.

<Resin>

The type of the resin contained in the ink has no particular limit and can be suitably selected to suit to a particular application. Specific examples thereof include, but are not limited to, urethane resins, polyester resins, acrylic-based resins, vinyl acetate-based resins, styrene-based resins, butadiene-based resins, styrene-butadiene-based resins, vinylchloride-based resins, acrylic styrene-based resins, and acrylic silicone-based resins.

Particles of such resins may be also used. It is possible to mix a resin emulsion in which the resin particles are dispersed in water serving as a dispersion medium with materials such as a coloring agent and an organic solvent to obtain ink. The resin particle can be synthesized or is available on the market. It is possible to synthesize the resin particle or obtain from market. These can be used alone or in combination of the resin particles.

The volume average particle diameter of the resin particle is not particularly limited and can be suitably selected to suit to a particular application. The volume average particle diameter is preferably from 10 through 1,000 nm, more preferably from 10 through 200 nm, and furthermore preferably from 10 through 100 nm to obtain good fixability and image hardness.

The volume average particle diameter can be measured by using a particle size analyzer (Nanotrac Wave-UT151, manufactured by MicrotracBEL Corp.).

The content of the resin is 5 percent by mass or greater and more preferably from 5 through 20 percent by mass to the total content of the ink in terms of fixability and storage stability of ink.

The particle diameter of the solid portion in ink has no particular limit and can be suitably selected to suit to a particular application. For example, the maximum frequency of the particle diameter of the solid portion of the ink in the maximum number conversion is preferably from 20 through 1,000 nm and more preferably from 20 through 150 nm to ameliorate the discharging stability and image quality such as image density. The solid portion includes resin particles, particles of pigments, etc. The particle diameter of the solid portion can be measured by using a particle size analyzer (Nanotrac Wave-UT151, manufactured by MicrotracBEL Corp).

<Additive>

Ink may further optionally contain a surfactant, a defoaming agent, a preservative and fungicide, a corrosion inhibitor, a pH regulator, etc.

Surfactant

Examples of the surfactant are silicone-based surfactants, fluorosurfactants, amphoteric surfactants, nonionic surfactants, anionic surfactants, etc.

The silicone-based surfactant has no specific limit and can be suitably selected to suit to a particular application. Among silicone-based surfactants, preferred are silicone-based surfactants which are not decomposed even in a high pH environment. Specific examples thereof include, but are not limited to, side-chain-modified polydimethylsiloxane, both end-modified polydimethylsiloxane, one-end-modified polydimethylsiloxane, and side-chain-both-end-modified polydimethylsiloxane. A silicone-based surfactant having a polyoxyethylene group or a polyoxyethylene polyoxypropylene group as a modifying group is particularly preferable because such an agent demonstrates good characteristics as an aqueous surfactant. It is possible to use a polyether-modified silicone-based surfactant as the silicone-based surfactant. A specific example thereof is a compound in which a polyalkylene oxide structure is introduced into the side chain of the Si site of dimethyl siloxane.

Specific examples of the fluoro surfactants include, but are not limited to, perfluoroalkyl sulfonic acid compounds, perfluoroalkyl carboxylic acid compounds, perfluoroalkyl phosphoric acid ester compounds, adducts of perfluoroalkyl ethylene oxide, and polyoxyalkylene ether polymer compounds having a perfluoroalkyl ether group in its side chain. These fluoro surfactants are particularly preferable because these fluoro surfactants do not foam easily. Specific examples of the perfluoroalkyl sulfonic acid compounds include, but are not limited to, perfluoroalkyl sulfonic acid and salts of perfluoroalkyl sulfonic acid. Specific examples of the perfluoroalkyl carboxylic acid compounds include, but are not limited to, perfluoroalkyl carboxylic acid and salts of perfluoroalkyl carboxylic acid. Specific examples of the polyoxyalkylene ether polymer compounds having a perfluoroalkyl ether group in its side chain include, but are not limited to, sulfuric acid ester salts of polyoxyalkylene ether polymer having a perfluoroalkyl ether group in its side chain and salts of polyoxyalkylene ether polymers having a perfluoroalkyl ether group in its side chain. Counter ions of salts in these fluorine-based surfactants are, for example, Li, Na, K, $NH_4$, $NH{:}CH_2CH_2OH$, $NH_2(CH_2CH_2OH)_2$, and $NH(CH_2CH_2OH)_3$.

Specific examples of the amphoteric surfactants include, but are not limited to, lauryl aminopropionic acid salts, lauryl dimethyl betaine, stearyl dimethyl betaine, and lauryl dihydroxy ethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan aliphatic acid esters, polyoxyethylene sorbitan aliphatic acid esters, and adducts of acetylene alcohol with ethylene oxides, etc.

Specific examples of the anionic surfactants include, but are not limited to, polyoxyethylene alkyl ether acetates, dodecyl benzene sulfonates, laurates, and polyoxyethylene alkyl ether sulfates.

These surfactants can be used alone or in combination.

The silicone-based surfactants have no particular limit and can be suitably selected to suit to a particular application. Specific examples thereof include, but are not limited to, side-chain-modified polydimethyl siloxane, both end-modified polydimethylsiloxane, one-end-modified polydimethylsiloxane, and side-chain-both-end-modified polydimethylsiloxane. In particular, a polyether-modified silicone-based surfactant having a polyoxyethylene group or a polyoxyethylene polyoxypropylene group as a modifying group is particularly preferable because such a surfactant demonstrates good characteristics as an aqueous surfactant.

Any suitably synthesized surfactant and any product thereof available on the market is suitable. Products available on the market are obtained from Byk Chemie Japan Co., Ltd., Shin-Etsu Chemical Co., Ltd., Dow Corning Toray Silicone Co., Ltd., NIHON EMULSION Co., Ltd., Kyoeisha Chemical Co., Ltd., etc.

The polyether-modified silicone-based surfactant has no particular limit and can be suitably selected to suit to a particular application. Examples thereof include a compound in which the polyalkylene oxide structure represented by the following general formula (S-1) is introduced into the side chain of the Si site of dimethyl polysiloxane.

General formula (S-1)

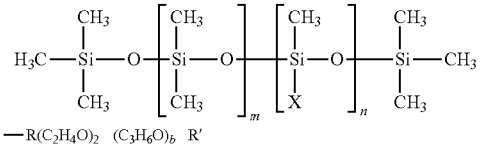

X = —$R(C_2H_4O)_2$ $(C_3H_6O)_b$ R′

In the general formula (S-1), "m", "n", "a", and "b" each, respectively represent integers, R represents an alkylene group, and R' represents an alkyl group.

Products available on the market may be used as the polyether-modified silicone-based surfactants. Specific examples of the products available on the market include, but are not limited to, KF-618, KF-642, and KF-643 (all manufactured by Shin-Etsu Chemical Co., Ltd.), EMALEX-SS-5602 and SS-1906EX (both manufactured by NIHON EMULSION Co., Ltd.), FZ-2105, FZ-2118, FZ-2154, FZ-2161, FZ-2162, FZ-2163, and FZ-2164 (all manufactured by Dow Corning Toray Silicone Co., Ltd.), BYK-33 and BYK-387 (both manufactured by Byk Chemie Japan Co., Ltd.), and TSF4440, TSF4452, and TSF4453 (all manufactured by Toshiba Silicone Co., Ltd.).

A fluorosurfactant in which the number of carbon atoms replaced with fluorine atoms is from 2 through 16 and more preferably from 4 through 16 is preferable.

Specific examples of the fluorosurfactants include, but are not limited to, perfluoroalkyl phosphoric acid ester compounds, adducts of perfluoroalkyl ethylene oxide, and polyoxyalkylene ether polymer compounds having a perfluoroalkyl ether group in its side chain. Of these fluorosurfactants, polyoxyalkylene ether polymer compounds having a perfluoroalkyl ether group in its side chain are preferable because these compounds do not foam easily and the fluorosurfactant represented by the following general formula (F-1) or general formula (F-2) is particularly preferable.

$$CF_3CF_2(CF_2CF_2)_m—CH_2CH_2CH_2CH_2O)_nH \quad \text{General formula (F-1)}$$

In the general formula (F-1), "m" is preferably an integer of from 0 through 10 and "n" is preferably an integer of from 0 through 40 in order to provide water solubility.

$$C_nF_{2n+1}—CH_2CH(OH)CH_2—O—(CH_2CH_2C)_a—Y \quad \text{General formula (F-2)}$$

In general formula (F-2), Y represents H, $C_mF_{2m+1}$, where "m" is an integer of from 1 through 6, $CH_2CH(OH)CH_2—C_mF_{2m+1}$, where "m" represents an integer of from 4 through 6, or $C_pH_{2p+1}$, where p represents an integer of from 1 through 19. "n" represents an integer of from 1 through 6. "a" represents an integer of from 4 through 14.

Products available on the market may be used as the fluorosurfactant. Specific examples of the products available on the market include, but are not limited to, SURFLON S-111, SURFLON S-112, SURFLON S-113, SURFLON S-121, SURFLON S-131, SURFLON S-132, SURFLON S-141, and SURFLON S-145 (all manufactured by ASAHI GLASS CO., LTD.); FLUORAD FC-93, FC-95, FC-98, FC-129, FC-135, FC-170C, FC-430, and FC-431 (all manufactured by SUMITOMO 3M); MEGAFAC F-470, F-1405, and F-474 (all manufactured by DIC CORPORATION); ZONYL™ TBS, FSP, FSA, FSN-100, FSN, FSO-100, FSO, FS-300, UR, CAPSTONE® FS-30, FS-31, FS-3100, FS-34, and FS-35 (all manufactured by The Chemours Company); FT-110, FT-250, FT-251, FT-400S, FT-150, and FT-400SW (all manufactured by NEOS COMPANY LIMITED); POLYFOX PF-136A, PF-156A, PF-151N, PF-154, and PF-159 (manufactured by OMNOVA SOLUTIONS INC.), and UNIDYNE DSN-403N (manufactured by DAIKIN INDUSTRIES). Of these products, FS-3100, FS-34, and FS-300 (all manufactured by The Chemours Company), FT-110, FT-250, FT-251, FT-400S, FT-150, and FT-400SW (all manufactured by NEOS COMPANY LIMITED), POLYFOX PF-151N (manufactured by OMNOVA SOLUTIONS INC.), and UNIDYNE DSN-403N (manufactured by DAIKIN INDUSTRIES) are particularly preferable in terms of good printing quality, coloring in particular, and improvement on permeation, wettability, and uniform dyeing property to paper.

The proportion of the surfactant in ink is not particularly limited and can be suitably selected to suit to a particular application. It is preferably from 0.001 through 5 percent by mass and more preferably from 0.05 through 5 percent by mass in terms of excellent wettability and discharging stability and improvement on image quality.

<Defoaming Agent>

The defoaming agent has no particular limit. For example, silicone-based defoaming agents, polyether-based defoaming agents, and aliphatic acid ester-based defoaming agents are suitable. These defoaming agents can be used alone or in combination. Of these defoaming agents, silicone-based defoaming agents are preferable to easily break foams.

<Preservatives and Fungicides>

The preservatives and fungicides are not particularly limited. A specific example is 1,2-benzisothiazolin-3-on.

<Corrosion Inhibitor>

The corrosion inhibitor has no particular limit. Examples thereof are acid sulfite and sodium thiosulfate.

<pH Regulator>

The pH regulator has no particular limit. It is preferable to adjust the pH to 7 or higher. Specific examples thereof include, but are not limited to, amines such as diethanol amine and triethanol amine.

Examples of the liquid discharging apparatus include an apparatus of which liquid discharging heads and articles to which the liquid can be attached are moved relative to each other. However, the liquid discharging apparatus is not limited to this type. Specific examples include a serial type apparatus in which the liquid discharging heads are caused to move and a line type apparatus in which the liquid discharging heads are not moved.

All of such terms as image formation, recording, printing, and object formation have the same meaning.

EXAMPLES

The present disclosure will be more specifically described by way of Examples and Comparative Examples. The present disclosure should not be construed as being limited to these Examples. In the following description, "part" represents "part by mass".

<Synthesis of Copolymer CP-1>

[Monomer M-1] represented by the structural formula (4) below was synthesized according to a synthesis example of Japanese Unexamined Patent Application Publication No. 2016-196621. Acrylic acid (available from Sigma-Aldrich Co. LLC) (1.20 g) (16.7 mmol) and [Monomer M-1] (7.12 g) (16.7 mmol) were dissolved in dry methyl ethyl ketone (40 mL), to prepare a monomer solution. Ten percent of the monomer solution was heated to 75 degrees C. under an argon current. Subsequently, to the resultant, a solution obtained by dissolving 2,2'-azoiso(butyronitrile) (available from Tokyo Chemical Industry Co., Ltd.) (0.273 g) (1.67 mmol) in the remaining monomer solution was dropped for 1.5 hours. The resultant was stirred at 75 degrees C. for 6 hours. The resultant was cooled to room temperature, and the obtained reaction solution was fed to hexane. A precipitated copolymer was filtrated, and dried at reduced pressure, to obtain 8.23 g of [Copolymer CP-1] (with a weight average molecular weight (Mw) of 9,500, and a number average molecular weight (Mn) of 3,400).

Structural formula (4)

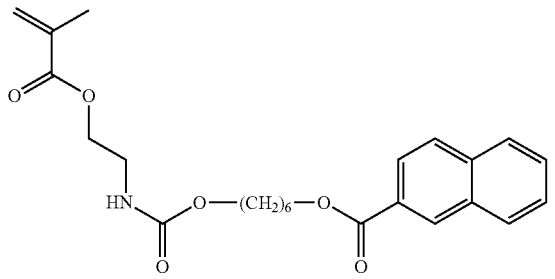

<Preparation of Pigment Dispersion>

—Preparation of Pigment Dispersion PD-1—

The obtained [Copolymer CP-1] (4.0 parts) was dissolved in a diethanolamine aqueous solution (80.0 parts) in a manner that pH would become 8.0. To the obtained copolymer aqueous solution (84.0 parts), carbon black (NIPEX 150, available from Orion Engineered Carbons) (16.0 parts) was added and stirred for 12 hours. The obtained mixture was subjected to circulation dispersion treatment for 1 hour using a disk-type bead mill (available from Shinmaru Enterprises Corporation, KDL type, using zirconia balls having a diameter of 0.1 mm as media) at a circumferential speed of 10 m/s, and filtrated through a membrane filter having an average pore diameter of 1.2 micrometers. To the resultant, ion-exchanged water was added in an amount for adjustment, to obtain 97.0 parts by mass of [Pigment dispersion PD-1] (with a pigment solid concentration of 16% by mass).

—Preparation of Pigment Dispersion PD-2—

The obtained [Copolymer CP-1] (4.0 parts) was dissolved in a diethanolamine aqueous solution (76.0 parts) in a manner that pH would become 8.0. To the obtained copolymer aqueous solution (80.0 parts), Pigment blue 15:3 (CHROMOFINE BLUE A-220JC, available from Dainichiseika Color & Chemicals Mfg. Co., Ltd.) (20.0 parts) was added and stirred for 12 hours. The obtained mixture was subjected to circulation dispersion treatment for 1 hour using a disk-type bead mill (available from Shinmaru Enterprises Corporation, KDL type, using zirconia balls having a diameter of 0.1 mm as media) at a circumferential speed of 10 m/s, and filtrated through a membrane filter having an average pore diameter of 1.2 micrometers. To the resultant, ion-exchanged water was added in an amount for adjustment, to obtain 97.0 parts by mass of [Pigment dispersion PD-2] (with a pigment solid concentration of 20% by mass).

—Preparation of Pigment Dispersion PD-3—

The obtained [Copolymer CP-1] (4.0 parts) was dissolved in a diethanolamine aqueous solution (76 parts) in a manner that pH would become 8.0. To the obtained copolymer aqueous solution (80.0 parts), Pigment red 122 (TONER MAGENTA EO02, available from Clariant AG) (20.0 parts) was added and stirred for 12 hours. The obtained mixture was subjected to circulation dispersion treatment for 1 hour using a disk-type bead mill (available from Shinmaru Enterprises Corporation, KDL type, using zirconia balls having a diameter of 0.1 mm as media) at a circumferential speed of 10 m/s, and filtrated through a membrane filter having an average pore diameter of 1.2 micrometers. To the resultant, ion-exchanged water was added in an amount for adjustment, to obtain 97.0 parts by mass of [Pigment dispersion PD-3] (with a pigment solid concentration of 20% by mass).

—Preparation of Pigment Dispersion PD-4—

The obtained [Copolymer CP-1] (2 parts) was dissolved in a potassium hydroxide aqueous solution (78 parts) in a manner that pH would become 8.0. To the obtained copolymer aqueous solution (80.0 parts), Pigment yellow 74 (FAST YELLOW 531, available from Dainichiseika Color & Chemicals Mfg. Co., Ltd.) (20.0 parts) was added and stirred for 12 hours. The obtained mixture was subjected to circulation dispersion treatment for 1 hour using a disk-type bead mill (available from Shinmaru Enterprises Corporation, KDL type, using zirconia balls having a diameter of 0.1 mm as media) at a circumferential speed of 10 m/s, and filtrated through a membrane filter having an average pore diameter of 1.2 micrometers. To the resultant, ion-exchanged water was added in an amount for adjustment, to obtain 97.0 parts by mass of [Pigment dispersion PD-4] (with a pigment solid concentration of 20% by mass).

<Preparation of Resin Particle Dispersion 1>

In a 1 L flask equipped with a mechanical stirrer, a thermometer, a nitrogen gas introducing tube, a reflux condenser, and a dropping funnel and sufficiently purged with a nitrogen gas, LATEMUL S-180 (available from Kao Corporation, a reactive anionic surfactant) (8.0 g) was mixed with ion-exchanged water (350 g), and elevated in temperature to 65 degrees C.

Next, to the resultant, t-butylperoxobenzoate (3.0 g) and sodium isoascorbate (1.0 g) as reaction initiators were added, and 5 minutes later, a mixture of methyl methacrylate (45 g), methacrylic acid-2-ethylhexyl (160 g), acrylic acid (5 g), butyl methacrylate (45 g), cyclohexyl methacrylate (30 g), vinyl triethoxysilane (15 g), LATEMUL S-180 (8.0 g), and ion-exchanged water (340 g) was dropped for 3 hours.

Next, the resultant was heated and aged at 80 degrees C. for 2 hours, subsequently cooled to normal temperature, and adjusted to pH of from 7 through 8 with sodium hydroxide.

Next, from the resultant, ethanol was evaporated with an evaporator for moisture content adjustment, to obtain an acrylic-silicone polymer particle dispersion ([Resin particle dispersion 1]) (730 g) with a solid concentration of 40%.

The volume average particle diameter (D50) of the polymer particles in the dispersion measured with a particle size analyzer (available from Nikkiso Co., Ltd., NANOTRAC UPA-EX150) was 125 nm.

Example 1

—Production of Ink GJ-1—

[Pigment dispersion PD-1] (40 parts by mass), [Resin particle dispersion 1] (13 parts by mass), 3-methyl-1,3-butanediol (7 parts by mass), 1,2-propanediol (16 parts by mass), 3-ethyl-3-hydroxymethyloxetane (4 parts by mass), N,N-dimethyl-6-ethoxypropionamide (5 parts by mass), UNIDYNE DSN-403N (available from DAIKIN INDUSTRIES) (2 parts by mass), and ion-exchanged water (13 parts by mass) were mixed and stirred for 1 hour, and subsequently filtrated through a membrane filter having an average pore diameter of 1.2 micrometers, to produce [Ink GJ-1] of Example 1.

Examples 2 to 5

—Production of Inks GJ-2 to 5—

[Inks GJ-2 to 5] of Examples 2 to 5 were produced in the same manner as in Example 1, except that the ink preparation of Example 1 was changed to as presented in Table 1.

Preparations of [Inks GJ-1 to 5] of Examples 1 to 5 are presented in Table 1.

TABLE 1

| Material | | Ex. 1 Ink GJ-1 | Ex. 2 Ink GJ-2 | Ex. 3 Ink GJ-3 | Ex. 4 Ink GJ-4 | Ex. 5 Ink GJ-5 |
|---|---|---|---|---|---|---|
| Pigment dispersion | PD-1 (Bk dispersion) | 40 | | | | 40 |
| | PD-2 (Cy dispersion) | | 40 | | | |
| | PD-3 (Ma dispersion) | | | 40 | | |
| | PD-4 (Ye dispersion) | | | | 40 | |
| Resin | *Resin particle dispersion 1 | 13 | 13 | 15 | 13 | 13 |
| Organic solvent A | 3-Methyl-1,3-butanediol | 7 | 3 | | 10 | |
| | 2-Methyl-1,3-propanediol | | | 8 | | 12 |
| Organic solvent B | 1,2-Propanediol | 16 | 18 | | 10 | 10 |
| | 1,3-Butanediol | | 2 | 14 | | |
| Organic solvent C | 3-Ethyl-3-hyroxymethyloxetane | 4 | | | 15 | |
| | N,N-dimethyl-β-butoxypropionamide | | 10 | | | 15 |
| | N,N-dimethyl-β-ethoxypropionamide | 5 | | 5 | | |
| Surfactant | UNIDYNE DSN-403N | 2 | | | 1 | 2 |
| | TEGO WET-270 | | 2 | 2 | 1 | |
| Water | Ion-exchanged water | 13 | 12 | 16 | 10 | 8 |
| Total | | 100 | 100 | 100 | 100 | 100 |
| Organic solvent A/Organic solvent B | | 0.4 | 0.2 | 0.6 | 1.0 | 1.2 |
| Organic solvent A + Organic solvent B | | 23 | 23 | 22 | 20 | 22 |
| Organic solvent A + Organic solvent B + Organic solvent C | | 32 | 33 | 27 | 35 | 37 |

*Resin particle dispersion 1 has a solid concentration of 40%.

In Table 1, TEGO WET-270 is a polyether-modified siloxane compound surfactant available from Evonik Corporation.

<Evaluation of Inks>

The deposition property of the inks of Examples 1 to 5 was evaluated according to the method described below. The results are presented in Table 2.

[Evaluation of Deposition Property]

A disposable syringe (TERUMO SYRINGE SS-20ESZP) was filled with each of the inks of Examples 1 to 5, mounted with an injection needle (attachment of TERUMO SYRINGE SS-01T2613S), and drained of gas and liquid. In an environment adjusted to 32 degrees C. and 30% RH, the disposable syringe filled with the ink was set in a syringe pump in a manner that the syringe extruding direction was parallel with a laboratory table, and the ink was dropped onto the above-described absorbers D and E for 15 hours under a dropping condition of 0.5 microliters/min. Presence or absence of deposition over the absorbers after dropping was confirmed, to evaluate the deposition property according to the evaluation criteria described below. B and A are non-problematic levels for practical use.

[Evaluation Criteria]

A: The ink was absorbed into the absorber and did not deposit over the absorber.

B: The ink partially remained over the absorber, but had flowability and did not deposit.

C: The ink over the absorber had almost no flowability and deposited.

TABLE 2

| | Evaluation of deposition property | |
|---|---|---|
| | Absorber D | Absorber E |
| Ex. 1 | A | A |
| Ex. 2 | A | A |
| Ex. 3 | A | A |
| Ex. 4 | A | A |
| Ex. 5 | B | B |

Results of comparing ink deposition heights over the absorbers when the inks were dropped onto the absorbers for a certain period of time are presented in Table 3.

TABLE 3

| Absorber | Deposition height [mm] |
|---|---|
| A | 0.66 |
| B | 0.84 |
| C | 1.00 |
| D | 0.34 |

As described above, it can be seen that the inks of Examples 1 to 5 had a low tendency toward deposition when dummy-discharged. Particularly, it can be seen that the inks had a low tendency toward deposition over the absorbers D and E, which were formed of melamine foam having an absorbing speed of higher than 10 nl/ms and a capillary force of lower than 10 mm.

What is claimed is:

1. A liquid discharging apparatus, comprising:

a liquid discharging unit configured to discharge a liquid; and a dummy discharge receptacle that comprises an absorbing member configured to absorb a liquid dummy-discharged by the liquid discharging unit, wherein the liquid discharging unit discharges a liquid having a resin content of 5% by mass or greater, wherein the absorbing member of the dummy discharge receptacle is formed of melamine foam, wherein the absorbing member comprises a first absorbing member, and a second absorbing member as a lower layer of the first absorbing member, wherein the first absorbing member is the melamine foam divided into a plurality of blocks in an in-plane direction of a surface over which the liquid dummy-discharged lands, and wherein an area of the second absorbing member is larger than an area of one block of the first absorbing member.

2. The liquid discharging apparatus according to claim 1, wherein the melamine foam is melamine foam having an absorbing speed of higher than 10 nl/ms and a capillary force of lower than 10 mm.

3. The liquid discharging apparatus according to claim 1, wherein the absorbing member is divided into plurality of blocks in the in-plane direction of the surface over which the liquid dummy-discharged lands.

4. The liquid discharging apparatus according to claim 3, wherein some blocks of the plurality of blocks are impregnated with a humectant liquid.

5. The liquid discharging apparatus according to claim 1, wherein the second absorbing member has a capillary force higher than a capillary force of the melamine foam.

6. The liquid discharging apparatus according to claim 1, wherein the first absorbing member and the second absorbing member are engaged with each other by a boss and a dent.

7. The liquid discharging apparatus according to claim 1, wherein the liquid contains a coloring material, a resin, an organic solvent A, and an organic solvent B, wherein the organic solvent A comprises alkyl alkanediol having alkanediol containing 3 through 6 carbon atoms as a main chain and an alkyl group containing 1 through 2 carbon atoms as a branched chain, and wherein the organic solvent B comprises a polyvalent alcohol having an equilibrium moisture content of 30% by mass or greater at a relative humidity of 80% and a saturated vapor pressure of 20 mmHg or higher at 100 degrees C.

8. The liquid discharging apparatus according to claim 7, wherein a ratio by mass (A/B) between a content (% by mass) of the organic solvent A and a content (% by mass) of the organic solvent B in the liquid is 1 or less.

9. The liquid discharging apparatus according to claim 7, wherein the liquid contains an organic solvent C having a solubility parameter of 9 or greater but 11 or less.

10. The liquid discharging apparatus according to claim 7, wherein the liquid contains a copolymer having a structural unit represented by a general formula (1) below, General formula (1)

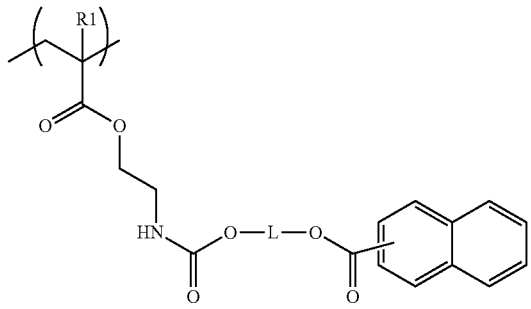

where in the general formula (1), R1 represents a hydrogen atom or a methyl group, and L represents an alkylene group containing 2 or more but 18 or less carbon atoms.

11. A liquid discharging apparatus, comprising:

a liquid discharging unit configured to discharge a liquid; and a dummy discharge receptacle that comprises an absorbing member configured to absorb a liquid dummy-discharged by the liquid discharging unit, wherein the liquid discharging unit discharges a liquid having a resin content of 5% by mass or greater, wherein the absorbing member of the dummy discharge receptacle is formed of melamine foam, and wherein the melamine foam is melamine foam having an absorbing speed of higher than 10 nl/ms and a capillary force of lower than 10 mm.

12. A liquid discharging apparatus, comprising:

a liquid discharging unit configured to discharge a liquid; and a dummy discharge receptacle that comprises an absorbing member configured to absorb a liquid dummy-discharged by the liquid discharging unit, wherein the liquid discharging unit discharges a liquid having a resin content of 5% by mass or greater, wherein the absorbing member of the dummy discharge receptacle is formed of melamine foam, wherein the liquid contains a coloring material, a resin, an organic solvent A, and an organic solvent B, wherein the organic solvent A comprises alkyl alkanediol having alkanediol containing 3 through 6 carbon atoms as a main chain and an alkyl group containing 1 through 2 carbon atoms as a branched chain, and wherein the organic solvent B comprises a polyvalent alcohol having an equilibrium moisture content of 30% by mass or greater at a relative humidity of 80% and a saturated vapor pressure of 20 mmHg or higher at 100 degrees C.

* * * * *